US007604505B2

(12) United States Patent
Zayas

(10) Patent No.: US 7,604,505 B2
(45) Date of Patent: Oct. 20, 2009

(54) ULTRAVIOLET LAMP FOR USE IN WATER PURIFIERS

(75) Inventor: Betty Jean Zayas, Bridgeport, CT (US)

(73) Assignee: Light Sources, Inc., Orange, CT (US)

( * ) Notice: Subject to any disclaimer, the term of this patent is extended or adjusted under 35 U.S.C. 154(b) by 0 days.

(21) Appl. No.: 12/032,187

(22) Filed: Feb. 15, 2008

(65) Prior Publication Data

US 2008/0188131 A1 Aug. 7, 2008

Related U.S. Application Data

(63) Continuation-in-part of application No. 11/870,256, filed on Oct. 10, 2007, which is a continuation-in-part of application No. 11/675,315, filed on Feb. 15, 2007, now Pat. No. 7,390,222.

(60) Provisional application No. 60/777,213, filed on Feb. 27, 2006.

(51) Int. Cl.
*H01J 5/54* (2006.01)

(52) U.S. Cl. ..... 439/617; 439/236; 439/680; 439/732; 439/924.1; 439/934

(58) Field of Classification Search ..... 439/617, 439/677, 680, 934, 236, 924.1; 313/318.02, 313/318.06; 250/436, 504 R
See application file for complete search history.

(56) References Cited

U.S. PATENT DOCUMENTS

| | | | | |
|---|---|---|---|---|
| 2,135,267 | A | 11/1938 | Alden | |
| 2,297,188 | A | 9/1942 | Joyce | |
| 3,059,214 | A | 10/1962 | Heller | |
| 3,761,862 | A | 9/1973 | Spiteri | |
| 4,075,531 | A | 2/1978 | Marino | |
| 4,256,989 | A | 3/1981 | Trutner et al. | |
| 4,528,429 | A | 7/1985 | Dobson et al. | |
| 4,740,169 | A | 4/1988 | Gordon | |
| D300,215 | S | 3/1989 | Brenner et al. | |
| 4,990,099 | A | 2/1991 | Marin et al. | |
| 5,040,993 | A | 8/1991 | Krug et al. | |
| 5,120,268 | A | 6/1992 | Gerrans | |
| 5,166,527 | A | 11/1992 | Solymar | |
| 5,422,487 | A * | 6/1995 | Sauska et al. | 250/436 |
| 5,471,063 | A | 11/1995 | Hayes et al. | |
| 5,634,820 | A | 6/1997 | Vakil | |
| 5,727,963 | A | 3/1998 | Lemaster | |
| 6,165,013 | A | 12/2000 | Broussard | |

(Continued)

FOREIGN PATENT DOCUMENTS

| | | |
|---|---|---|
| GB | 694114 | 7/1953 |

(Continued)

OTHER PUBLICATIONS

Kaifeng, H., et al. "Design of a Fluorescent Lamp Control Platform Based on Power-line Carrier," Electronic Measurement and Instruments, 2007. ICEMI 2007, 8th International Conference, Aug. 16, 2007-Jul. 18, 2007: p. 1.

(Continued)

*Primary Examiner*—Neil Abrams
(74) *Attorney, Agent, or Firm*—Cantor Colburn LLP

(57) ABSTRACT

A lamp base may include a cylindrical body having an end surface, a first step portion and a second step portion, a first upper pin connector provided on the first step portion, a second upper pin connector provided on the second step portion, and a first and second lower pin connector provided on the end surface. Interfitting keys and recesses may also be used to insure that a lamp base is only coupled to an appropriate socket. Adapter blocks may be used to apply such recesses to an existing lamp.

20 Claims, 32 Drawing Sheets

U.S. PATENT DOCUMENTS

| | | | | |
|---|---|---|---|---|
| 6,250,947 | B1 | 6/2001 | Holzer | |
| 6,634,902 | B1 | 10/2003 | Pirovic | |
| 6,641,419 | B1 | 11/2003 | Richardson | |
| 6,884,103 | B1 | 4/2005 | Kovacs | |
| 7,137,728 | B2 | 11/2006 | Witham et al. | |
| 7,354,284 | B2 | 4/2008 | Aime et al. | |
| 7,390,222 | B2 * | 6/2008 | Ciancanelli et al. | 439/617 |
| 7,390,225 | B2 | 6/2008 | Elku et al. | |
| D575,742 | S | 8/2008 | Scherer et al. | |
| 2004/0247251 | A1 | 12/2004 | Rubino et al. | |
| 2008/0197291 | A1 | 8/2008 | Gerardi-Fraser et al. | |

FOREIGN PATENT DOCUMENTS

| | | |
|---|---|---|
| WO | 2006/136026 | 12/2006 |

OTHER PUBLICATIONS

International Search Report with Written Opinion, PCT/US08/54118, Date Mailed Oct. 24, 2008.

International Search Report with Written Opinion, PCT/US08/54121, Date Mailed Nov. 3, 2008.

International Search Report with Written Opinion, PCT/US07/04396, Date Mailed Aug. 20, 2008.

* cited by examiner

ULTRAVIOLET LAMP FOR USE IN WATER PURIFIERS

CROSS REFERENCE TO RELATED APPLICATIONS

This application is a continuation in part (CIP) of U.S. application Ser. No. 11/870,256, filed Oct. 10, 2007, the contents of which are herein incorporated by reference and priority to which is hereby claimed. The Ser. No. 11/870,256 application is a continuation in part (CIP) of U.S. application Ser. No. 11/675,315, filed Feb. 15, 2007 (issued as U.S. Pat. No. 7,390,222) which claimed the benefit of the date of earlier filed provisional application, U.S. Provisional Application No. 60/777,213, filed on Feb. 27, 2006, the contents of both of which are incorporated by reference herein, and priority to both which is hereby claimed.

BACKGROUND OF THE INVENTION

1. Field of the Invention

This invention generally relates to improvements in lamps, especially ultraviolet lamps used in air and water purifiers and disinfection units.

2. Description of Related Art

Ultraviolet air and water or other liquid purifiers are known for disinfecting contaminated air or water or other liquid for domestic, industrial, municipal, or commercial use. Such purifiers include at least one lamp for emitting ultraviolet radiation installed into a chamber over which contaminated air or water or other liquid pass to kill microorganisms therein. In conventional manner, the lamp includes two electrodes spaced apart within an elongated arc tube containing a gas, particularly noble gas with or without additives. A pair of end caps (i.e., bases) are mounted at the ends of the tube. Each electrode contains two lead wires from the lamp seal each of which, or in some instances only one, are electrically connected to respective contact(s) or terminal pin(s). The lamp is typically inserted endwise into a sleeve installed in the water, other liquid or air purifier with or without the use of an external quartz sleeve. To simplify insertion and electrical connection, the pins are conveniently mounted on one of the end caps. When the electrodes are energized by voltage from an electrical power supply, an electrical discharge is initiated in the gas between the electrodes. This discharge results from a reaction between the electrical energy, gas and mercury to produce ultraviolet radiation to be emitted from the lamp in a manner well known in the art.

An example of an ultraviolet lamp of the type described above is disclosed in U.S. Pat. No. 5,166,527 ('527), all of the contents of which are incorporated herein by reference. The '527 patent discloses a lamp, especially useful as an ultraviolet lamp for use in a water purifier, comprising an elongated, hollow arc tube extending along a longitudinal axis between opposite end regions. The tube contains a gas, preferably a noble gas with or without additives. A pair of electrodes is spaced apart along the longitudinal axis. The electrodes are respectively mounted within the arc tube at the end regions thereof. A pair of end caps is respectively mounted at the end regions of the arc tube. A first electrical contact or pair of electrical contacts or terminal pins extends in mutual parallelism along the longitudinal axis and is electrically connected to one or both of the electrode lead wires. A second electrical contact or pair of electrical contacts or terminal pins extends in mutual parallelism along the longitudinal axis and is electrically connected to one or both of the other of the electrode lead wires. Both pairs of pins are mounted on, and extend outwardly along the longitudinal axis of, one of the end caps. A wire conductor is, or two wire conductors are, located exteriorly of the tube and electrically connected to one pin or one pair of pins at one end region of the tube, as well as to the electrode at the other end region of the tube.

Two embodiments, of the lamp disclosed in the '527 patent are shown in prior art FIGS. 1 and 2. As shown in FIGS. 1 and 2, the pairs of pins are offset relative to each other along the longitudinal axis. This offset resists the formation of an electrical arc between the pairs of pins exteriorly of the arc tube, especially in the presence of the moisture-laden, humid environment of the water purifier.

Still referring to prior art FIGS. 1 and 2, the one end cap has a stepped outer end wall having a pair of wall portions lying in mutual parallelism in planes generally perpendicular to the longitudinal axis. The first pair of pins is supported on, and extends through, one of the end wall portions for a predetermined distance, and the second pair of pins is supported on, and extends through, the other of the end wall portions for the same predetermined distance. The planes of the end wall portions are spaced apart by a predetermined spacing larger than said predetermined distance in order to still further prevent electrical arcing between the pairs of pins exteriorly of the arc tube. A barrier wall internally of the one end cap physically separates the electrical connections to the two pairs of pins to resist the formation of an electrical arc between the pairs of pins interiorly of the one end cap. The barrier wall is advantageously made of the same non-conductive material as the one end cap.

In addition to the two-tiered stepped bases of the '527 patent, other multi-tiered bases have been manufactured including those bases shown in prior art FIGS. 3-7.

Although well-suited for their intended purposes, there continues to be a need for improved lamp base designs, particularly ultraviolet lamps.

There are many different types of lamps that have a base or end cap that can be connected with a socket to provide electrical connections to the lamps. The end cap and socket must be constructed to permit easy replacement of the lamp while securely holding the lamp. This may be particularly important in certain applications where vibration or movement of the lamp or lamp fixture could result in unintentional separation between the lamp's end cap and the socket. Additionally, the electrical connections must remain secure.

In some applications where a multiplicity of contact pins and/or pin orientations is utilized, it is often difficult to align the contact pins to make the electrical connection necessary to operate the lamp. Often, the contact pins may become misaligned or bent due to their extension or projection from the base of the lamp, preventing their insertion into a socket. It may also be possible to insert the end cap into a socket such that the contacts are not connected with the proper terminals in the socket, resulting in improper operation of the lamp. Also, on a typical "slide into place" male/female pin connector there is no locking or twist locking and thus the pins may slide out and become disconnected easily by vibration for example.

An example of an ultraviolet lamp of the type described above is disclosed in U.S. Pat. No. 5,166,527 ('527), which uses a stepped base with pins connector, all of the contents of which are incorporated herein by reference. The '527 patent discloses a lamp or bulb, used as an ultraviolet lamp for use in an air or water purifier, comprising an elongated, hollow arc tube extending along a longitudinal axis between opposite end regions. The tube contains a gas, preferably a noble gas with or without additives. A pair of electrodes is spaced apart along the longitudinal axis. The electrodes are respectively mounted within the arc tube at the end regions thereof. A pair of end caps is respectively mounted at the end regions of the arc tube. A first electrical contact or pair of electrical contacts or terminal pins extends in mutual parallelism along the longitudinal axis and is electrically connected to one or both of the electrode lead wires. A second electrical contact or pair of electrical contacts or terminal pins extends in mutual parallelism along the longitudinal axis and is electrically connected to one or both of the other of the electrode lead wires. Both pairs of pins are mounted on, and extend outwardly along the longitudinal axis of, one of the end caps. A wire conductor is, or two wire conductors are, located exteriorly of the tube and electrically connected to one pin or one pair of pins at one end region of the tube, as well as to the electrode at the other end region of the tube. This design is mainly designed to prevent electrical arcing and does not lock in place.

As noted in WO/2006/136026 to Elku et al. which is a variation of the slide-on pin connector above, a potential problem with this approach is that in many applications, the radiation lamp is immersed in a flow of water and turbulence created within that water treatment system invariably imparts a vibratory motion to the lamps. This frequently results in the lamp being vibrated or shaken loose of its electrical connection base or socket thereby causing the lamp to be rendered completely or intermittently inoperative. When such an event occurs, the water being treated may not be fully disinfected. The prior art has attempted to address this problem by using a relatively complicated mechanical connection (e.g., a so-called "push-and-twist" connection) to secure the lamp to the connection base. See, for example, U.S. Pat. No. 5,422,487 to Sauska et al. and U.S. Pat. No. 6,884,103 to Kovacs. The potential problem with these approaches is the complexity of the mechanical connection between the lamp and the base unit requiring the use of springs, specialized connection lugs and the like. Further, a connection system which is predicated on a dual motion system such that pushing and twisting if used incorrectly for example may give rise to higher incidents of lamp breakage, electrical shock, and other damage to the lamp by field personal. Therefore, eliminating a forceful "push" necessary to deflect a heavy locking spring in a "push and twist" lock would be beneficial because the typically glass lamp would be subject to reduced force and stress.

Also, it is important that lamps of proper wattage be used for safety, heat, and fire concerns. Thus, a unique keying system that only allows lamps of proper wattage to be inserted into the base will also help safety.

Accordingly, there remains the need in the art for a safety lamp device, particularly a radiation lamp, which will provide a reliable, locking, and secure from movement, electric connection, yet be relatively inexpensive, uncomplicated, durable, rugged, and simple to implement with smooth operation and with reduced force and stress on the lamp for safety purposes. Also, a lamp that reduces the chance of electrical shock is needed for safety purposes.

Thus, there continues to be a need for improved lamp base designs, particularly ultraviolet lamps.

SUMMARY OF THE INVENTION

In accordance with at least an embodiment of the present invention, a lamp base may include a cylindrical body having an end surface, a first step portion and a second step portion, a first upper pin connector provided on the first step portion, a second upper pin connector provided on the second step portion, and a first and second lower pin connector provided on the end surface.

The above-described end cap configuration for the lamp may be mated to a complimentary shaped receptacle known as a socket. The socket may be wired to a power source.

The designs will further allow for matching of the lamp and connector to a specific power supply to reduce the chance of connecting an ultraviolet lamp into an improperly matched power supply.

The lamp of this invention is preferably an ultraviolet lamp and finds particular application for use in a water, other liquid, or air purifier.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENTS

Figure 1:
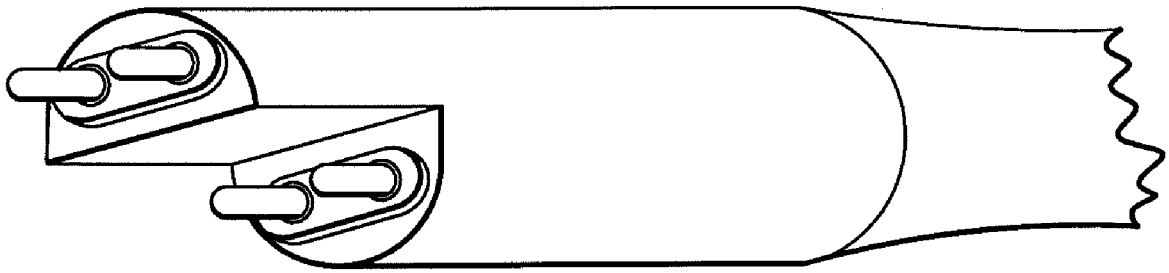
FIG. 1 PRIOR ART
FIGS. 1-7 are respective views of end caps used in ultraviolet lamps in accordance with the prior art.
Figure 2:
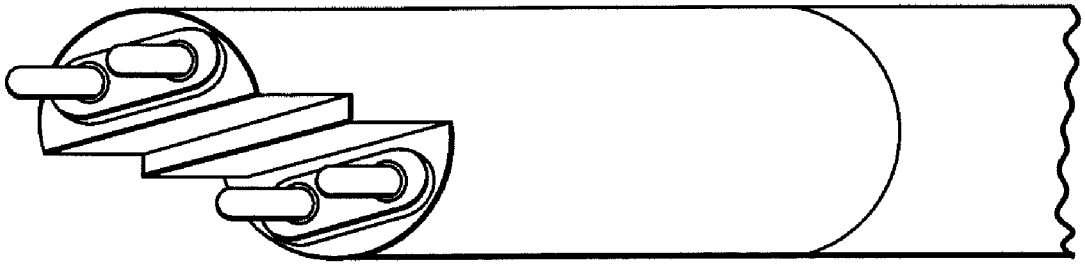
FIG. 2 PRIOR ART
Figure 3:
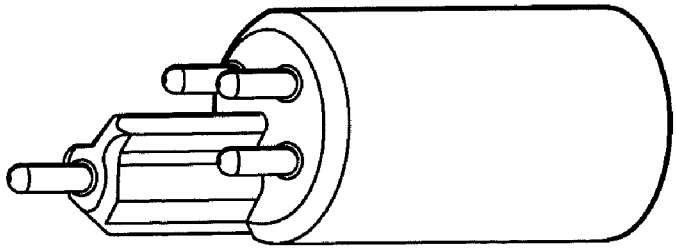
FIG. 3 PRIOR ART
Figure 4:
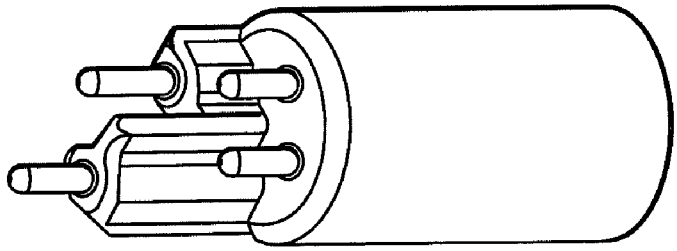
FIG. 4 PRIOR ART
Figure 5:
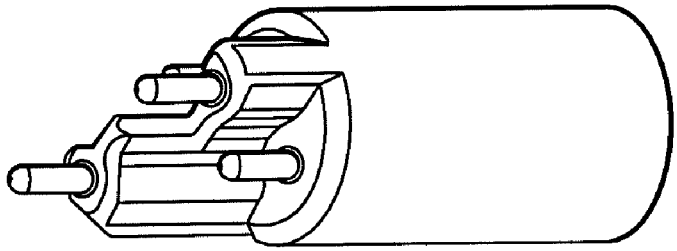
FIG. 5 PRIOR ART
Figure 6:
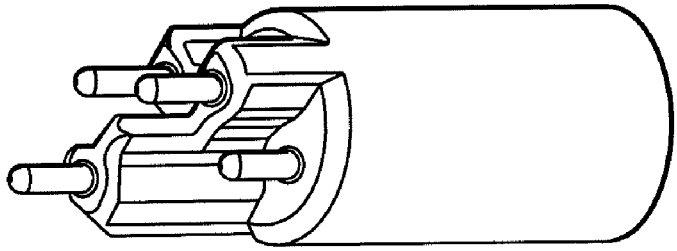
FIG. 6 PRIOR ART
Figure 7:
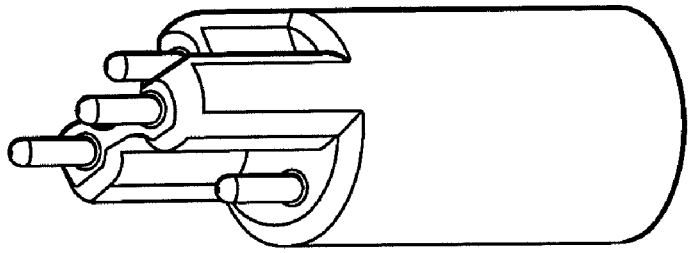
FIG. 7 PRIOR ART
Figure 8:
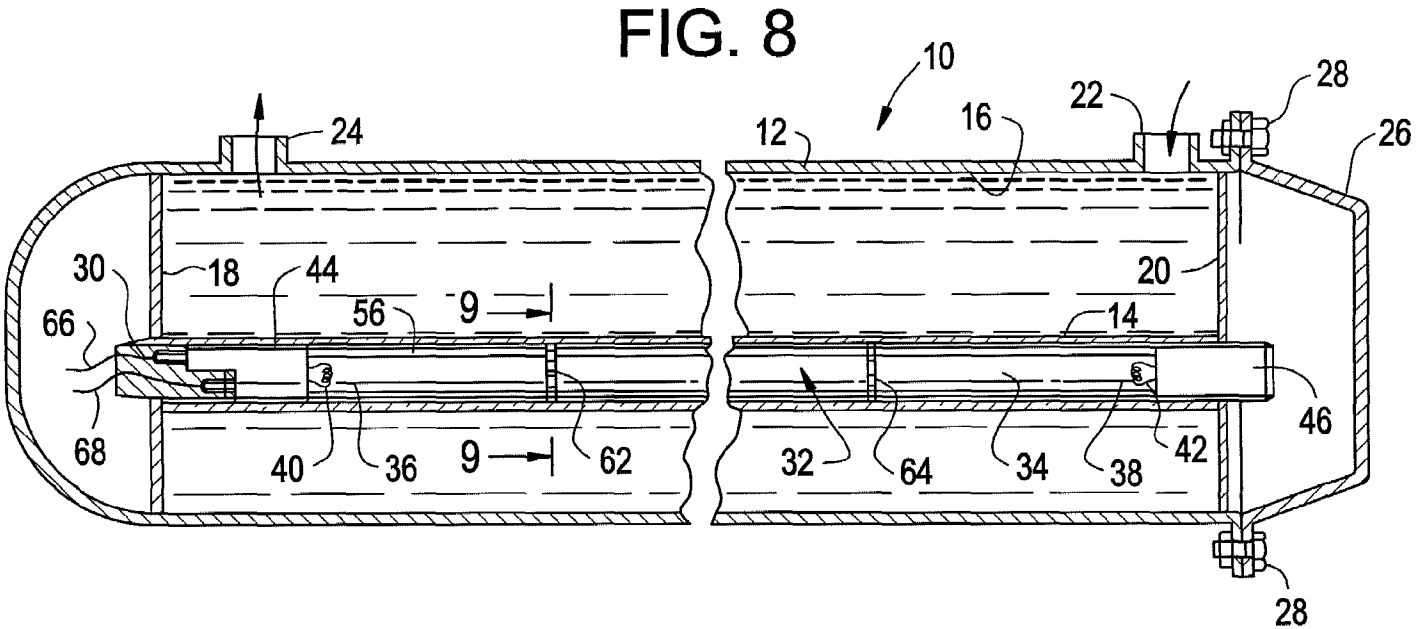
FIG. 8 is a cross-sectional view along the longitudinal axis of a water purifier employing the ultraviolet lamp in accordance with the present invention.

Referring now to FIG. 8 of the drawings, reference numeral 10 generally identifies a water purifier having a cylindrical housing 12 extending along a longitudinal axis. A hollow, axially-extending sleeve 14 is centrally mounted within the housing 12 between apertured support walls 18, 20 spaced apart along the longitudinal axis. The support walls 18, 20, together with the interior wall of the housing 12 and the exterior wall of the sleeve 14, bound an interior space 16. A water inlet 22 admits pressurized water to be purified into the space 16. A water outlet 24 discharges the purified water from the space 16. The space 16 serves as a flow-through passage for the water contained therein which, during the course of its flow, is exposed to ultraviolet radiation as described below.

A removable cover 26 overlies the support wall 18 at one end of the housing 12. The cover 26 is detachably coupled to the housing 12 by a set of threaded fasteners 28 to permit access to the interior of the sleeve 14 through the aperture of the support wall 18. An electrical socket 30 is removably mounted within the aperture of the support wall 18. An ultraviolet lamp 32 in accordance with this invention is slidably inserted into the interior of the sleeve 14 through the aperture of the support wall 18. An electrical connection, as described below, is made with the socket 30. In operation, the lamp 32 emits ultraviolet radiation of sufficient intensity to kill microorganisms in the water, other liquid or air contained in the space 16 to purify the same for domestic and commercial applications.

The lamp 32 includes an elongated, hollow, sealed, arc tube 34 constituted of a light-transmissive material, e.g. silica quartz or other ultraviolet transmitting glass tube. The tube 34 has opposite end regions 36,38 spaced apart along the longitudinal axis. A gas, preferably mercury vapor with or without additives, is sealingly contained within the tube.

Figure 10A:
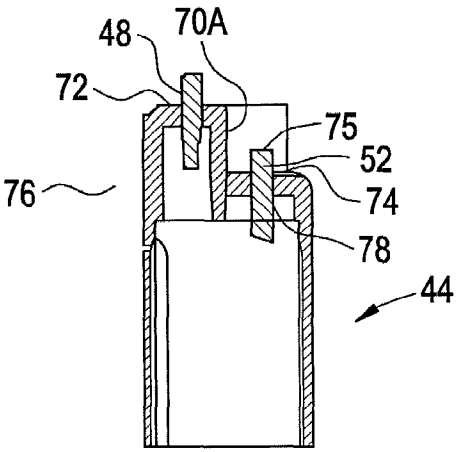
FIG. 10A is a cross-sectional elevation view along the line 10A-10A of FIG. 10.
Figure 9:
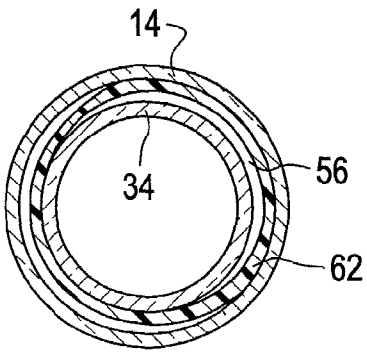
FIG. 9 is a cross-sectional elevation view along the line 9-9 of FIG. 8.

A pair of electrodes 40, 42 is respectively mounted within the tube at the end regions 36, 38. A pair of end caps 44, 46 constituted of a non-conducting material, e.g. ceramic, is respectively mounted at the end regions 36, 38 over the sealed end regions of the tube. Each end cap has a bore having a closed base against which a sealed end region of the tube abuts when the sealed end region is inserted fully into a respective end cap. End cap 44 (best show in FIGS. 10 and 10A) also has a barrier wall 70*a*, 70*b*, extending between semi-circular bases 72, 74 such that bases 72, 74 are stepped with base 72 being the upper or distal base and base 74 being the lower or proximal base. In accordance with an important feature of this invention, a male member 75 extends laterally from barrier wall 70*a*, 70*b*, along lower base 74. Member 75 is centrally positioned along wall 70*a*, 70*b* thus splitting the wall into the two sections 70*a* and 70*b*. Member 75 has a height which is equal to the distance between respective bases 72 and 74. Member 75 also acts to divide lower base 74 into two symmetrical sections (each comprising an approximately 90 degree quadrant).

Figure 10:
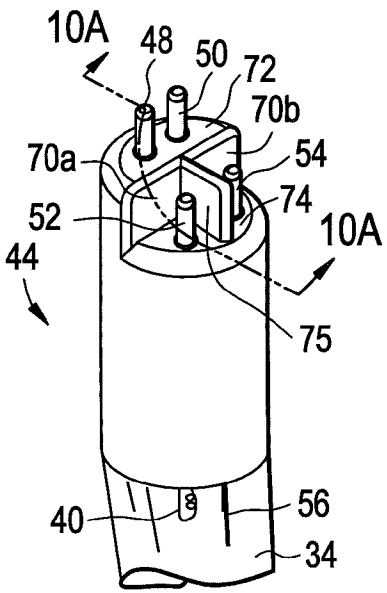
FIG. 10 is a perspective elevation view of a first embodiment of an end cap for a lamp in accordance with the present invention.
Figure 11:
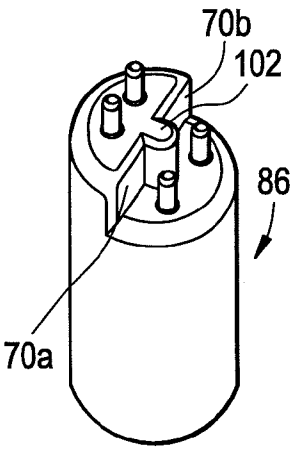
FIGS. 11-14 are perspective elevation views of second, third, fourth and fifth embodiments of end caps in accordance with the present invention.
Figure 12:
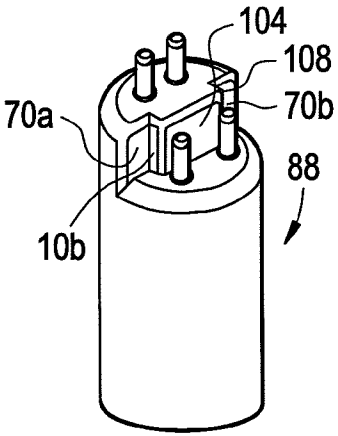

Still referring to FIG. 10, a first pair of electrical contacts or terminal pins 48, 50 extends in mutual parallelism along the longitudinal axis, and is mounted on, and extends outwardly of, the end cap 44 (through base 72). A second pair of electrical contacts or terminal pins 52, 54 also extends in mutual parallelism along the longitudinal axis, and is also mounted on, and extends outwardly of, the same end cap 44 (through base 74). Pins 52 and 54 are separated from one another by member 75. The pins 48, 50 extend into interior compartment 76, and the pins 52, 54 extend into compartment 78 (see FIG. 10A).

The pins 48, 50 are electrically connected within end cap 44 to one end of a wire conductor 56. The conductor 56 is located exteriorly of the tube 34, and extends along the longitudinal axis to the opposite end cap 46 wherein the other end of the conductor 56 is connected to the electrode 42. The pins 52, 54 are electrically connected within the end cap 44 to the electrode 40. The barrier wall 70*a*, 70*b* physically separates the pairs of pins.

Figure 15:
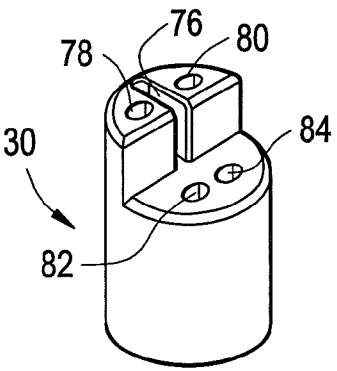
FIGS. 15-19 are perspective elevation views of sockets for the end caps of FIGS. 10-14, respectively.
Figure 16:
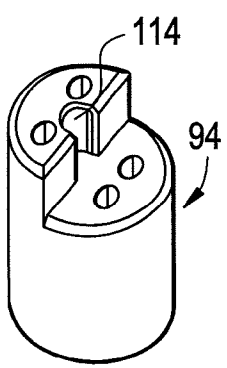
Figure 17:
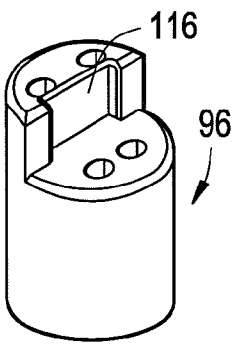
Figure 18:
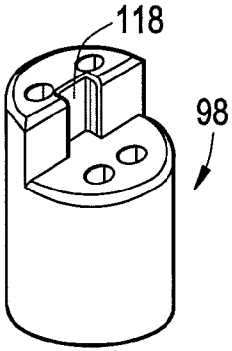
Figure 19:
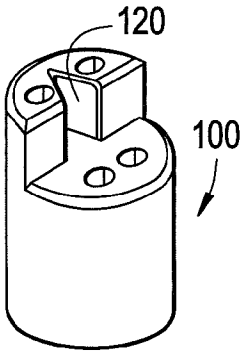
Figure 20:
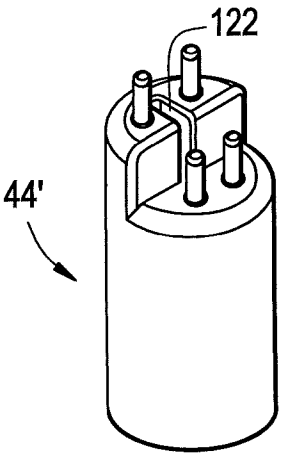
FIGS. 20-24 are perspective elevation views of additional embodiments of end caps having female recesses in accordance with yet other embodiments of the present invention.
Figure 21:
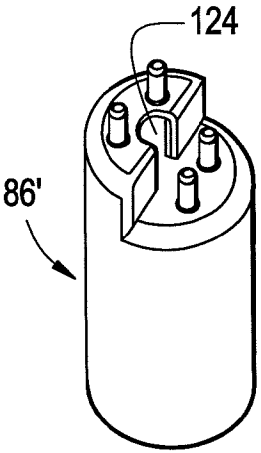
Figure 22:
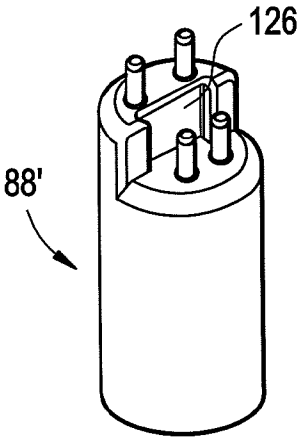

Thus, as shown in FIG. 10, the end cap 44 has a stepped, outer end wall having a pair of semi-circular end wall portions 72, 74 lying in mutual parallelism in planes generally perpendicular to the longitudinal axis. As best shown in FIG. 15, the socket 30 has a complementary stepped, outer end wall together with a centrally located recess 76. During mating, the pins 48, 50, 52, 54 will be received into respective sockets 78, 80, 82, 84 while member 75 is received into mating recess 76.

A set of centering rings 62, 64, preferably constituted of a synthetic plastic material, is located on tube 34, being placed thereon before the end caps are attached to the end regions of the tube 34. The rings 62, 64 coaxially surround the tube 34 and frictionally engage and support the tube, and assist in centering the tube within sleeve 14.

Figure 13:
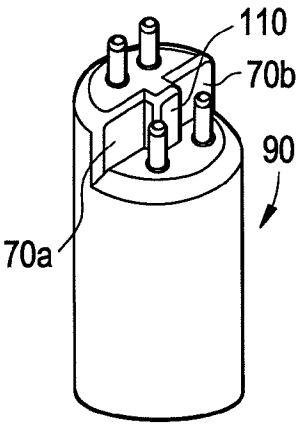
Figure 14:
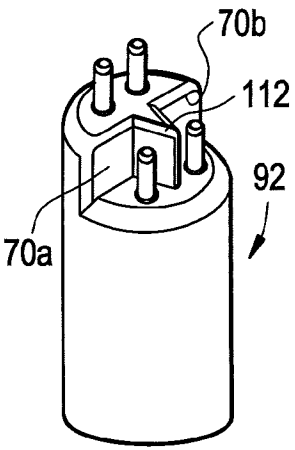

Referring now to FIGS. 11-14, additional embodiments of the end cap depicted in FIG. 10 are shown. All of these end caps have a similar configuration to that shown in FIG. 10 including a pair of parallel but longitudinally displaced semi-circular bases 72, 74 having a barrier wall 70*a*, 70*b*, extending therebetween so as to form a stepped base. In addition and in accordance with the present invention, a male member or extension extends centrally outwardly from barrier wall 70*a*, 70*b*. While this male extension was in the form of a relatively thin wall 75 in the end cap 44 of FIG. 10, the male extension takes on a differing geometric shape in the various embodiments shown in FIGS. 11-14. More specifically, the end cap 86 in FIG. 11 has a rounded arcuate shape (e.g., V-shaped, semi-circular shaped) extension 102 extending between barrier wall sections 70*a* and 70*b*. The end cap 88 in FIG. 12 has an extension 104 in the shape of a rectangular box which includes a pair of opposed sidewalls 106, 108 which extend outwardly from and perpendicularly to respective barrier wall sections 70*a* and 70*b*. The end cap 90 of FIG. 13 also has a box like extension 110 which is similar to extension 104 (in FIG. 12); however, extension 112 has a more square cross-section relative to the rectangular cross-section of extension 104. Thus, the barrier wall sections 70*a* and 70*b* in FIG. 13 are relatively larger than the respective barrier wall sections 70*a* and 70*b* in FIG. 12. End cap 92 in FIG. 14 is a V-shaped triangular shape extension member 112 which forms the divider between barrier wall sections 70*a* and 70*b*.

Significantly, all of the additional embodiments of FIGS. 11-14 have in common the feature of FIG. 10 wherein a male member extends outwardly from barrier wall 70*a*, 70*b*, and is coextensive with stepped (that is longitudinally displaced) base sections 72, 74. It will be appreciated that in accordance with this invention, the male member may have any suitable configuration besides those shown in FIGS. 10-14 and that such configuration may be symmetrical, asymmetrical, spherical, conical, aspheric or any other desired shapes.

As in the receptacle 30 shown in FIG. 15 which receives the end cap 44 in FIG. 10, the end caps of the embodiments of FIGS. 11-14 have similarly complimentary shaped respective receptacles 94, 96, 98 and 100 as shown in FIGS. 16-19, respectively. Thus, receptacle 94 of FIG. 16 has a rounded arcuate shaped recess 114 for receiving and mating with rounded or U-shaped extension 102 in FIG. 11. Similarly, receptacle 96 has a rectangular shaped recess 116 which is sized and configured to mate with and be received by rectangular extension 104 in FIG. 12. Receptacle 98 in FIG. 18 has a square shaped recess 118 for mating with and being received by square shaped extension 110 in FIG. 13 while receptacle 100 of FIG. 19 has a V-shaped recess 120 for mating with and being received by V-shaped extension 112 in FIG. 14. Again, it will be appreciated that the receptacles of FIGS. 15-19 may include a recess having any desired shape, so long as the shape is complimentary to, and can be received by, the shape of the extensions in the mating end cap.

Figure 23:
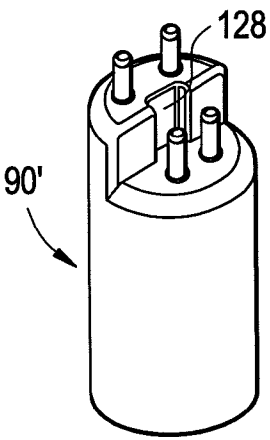
Figure 24:
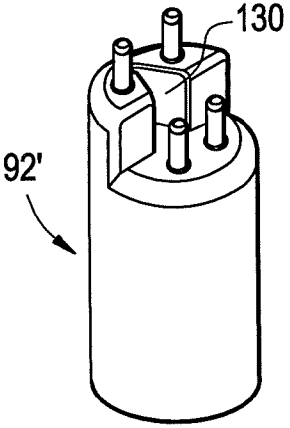

In still another alternative embodiment of the present invention, it will be appreciated that the male extension in the plug ended lamp and the female recess in the complimentary receptacle may be reversed such that the lamp cap will exhibit the recess while the receptacle will exhibit the complimentary male extension for mating with the recess in the cap. Such alternative configurations are shown in the end caps of FIGS. 20-24 and also in FIGS. 38-45. The end caps of FIGS. 20-24 and 38-45 are similar to the respective end caps shown in FIGS. 10-14 with the only difference being that the male extension has been substituted with the female recess in FIGS. 20-24. Thus, end cap 44' includes a narrow recess 122 (similar to the recess 76 shown in FIG. 15), end cap 86' and 86*a* include an arcuate shaped recess 124, 124*a* (similar to the recess 114 in FIG. 16), end cap 88' includes a rectangularly shaped recess 126 (similar to the recess 116 in FIG. 17), end cap 90' of FIG. 23 includes a square shaped recess 128 (similar to the recess 118 in FIG. 18) and end cap 92' of FIG. 24 includes a V-shaped recess 130 (similar to the V-shaped recess 120 of FIG. 19).

Figure 25:
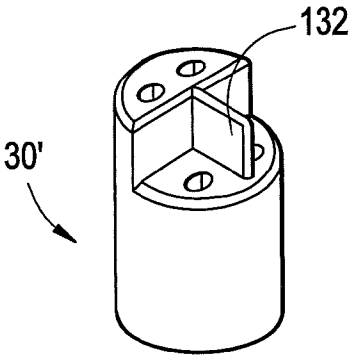
FIGS. 25-29 are perspective elevation views of sockets for the end caps of FIGS. 20-24, respectively.
Figure 26:
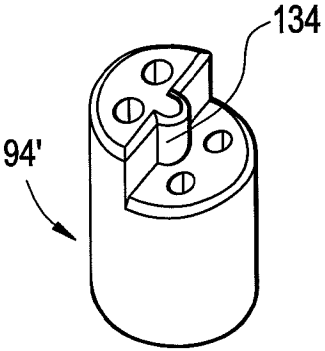
Figure 27:
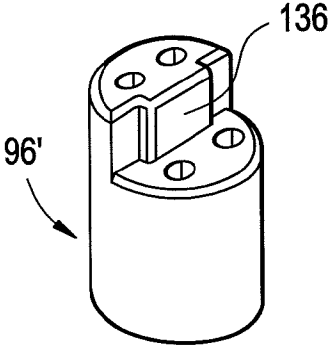
Figure 28:
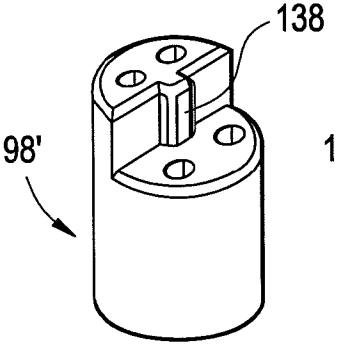
Figure 29:
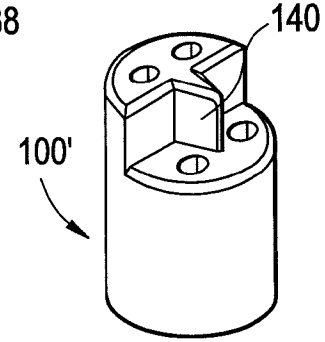
Figure 30:
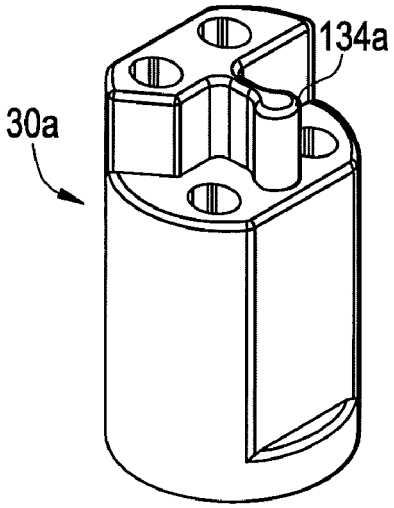
FIGS. 30-31 are perspective views of an embodiment of a socket useable with the lamp base shown in FIGS. 38-45.
Figure 31:
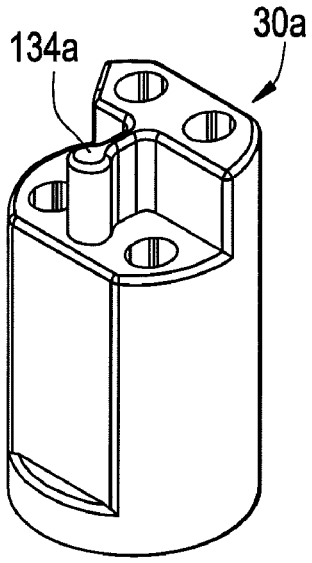
Figure 32:
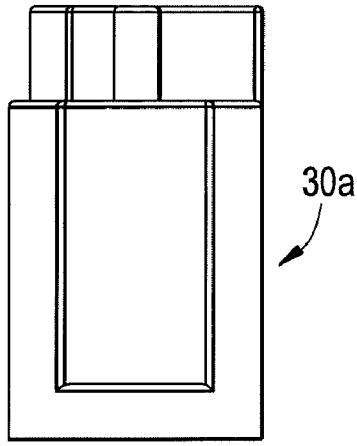
FIGS. 32-35 are side views of the embodiment shown in FIGS. 30-31.
Figure 33:
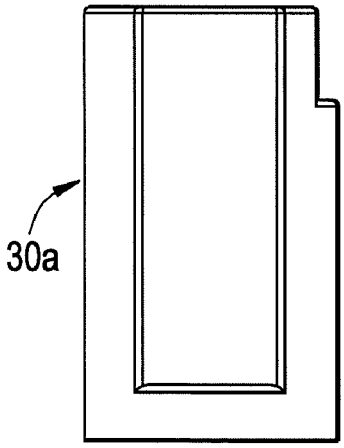
Figure 34:
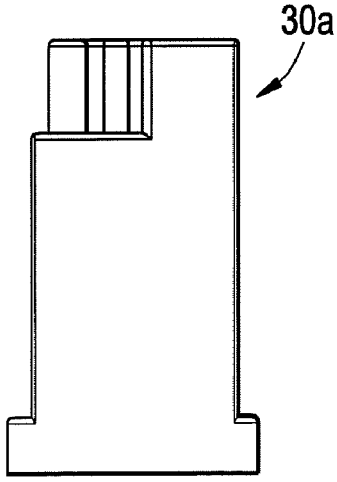
Figure 35:
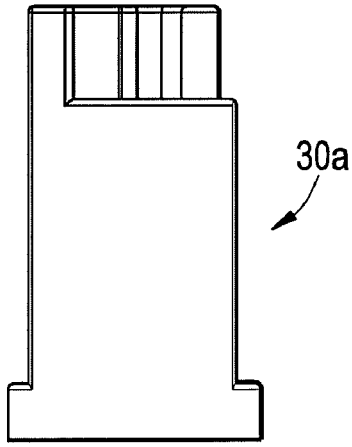
Figure 36:
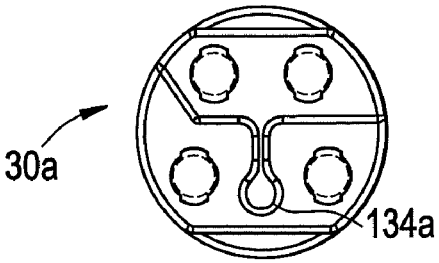
FIG. 36 is a top plan view of the embodiment shown in FIG. 30
Figure 37:
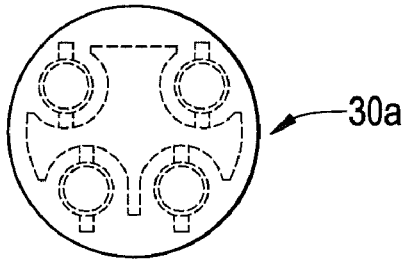
-FIG. 37 is a bottom plan view of the embodiment shown in FIG. 30-35.
Figure 38:
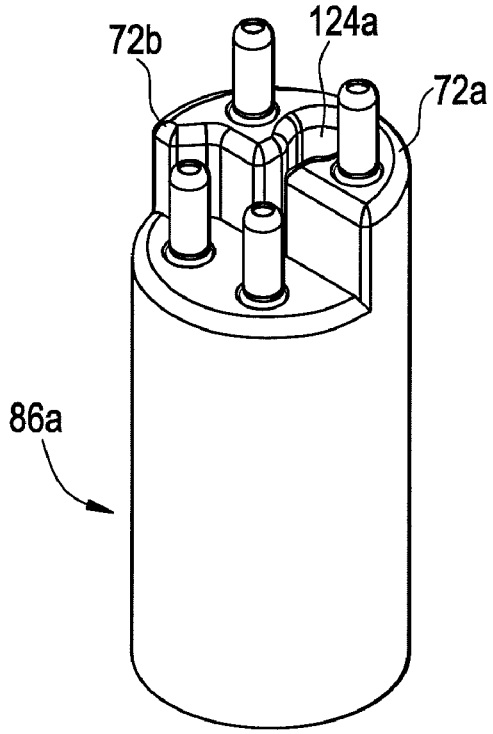
FIGS. 38-39 are perspective views of a lamp base useable with the socket of shown in FIGS. 30-37.
Figure 39:
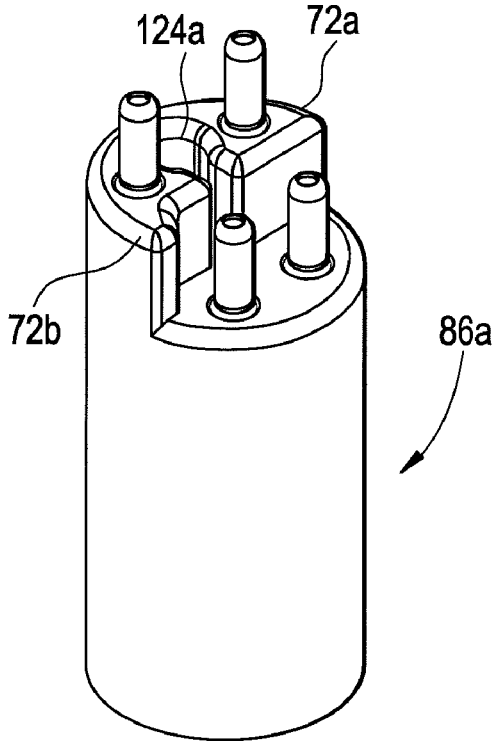
Figure 40:
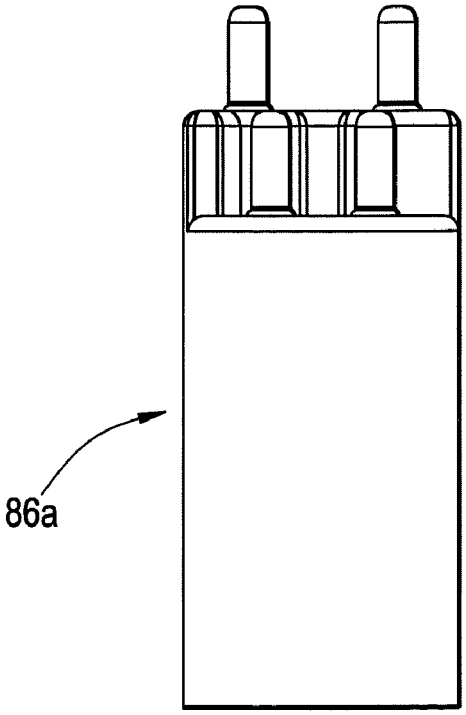
FIGS. 40-43 are side views of the base shown in FIGS. 38-39.
Figure 41:
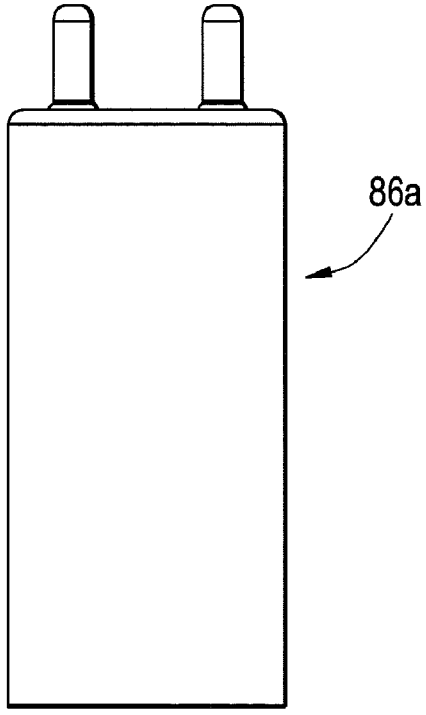
Figure 42:
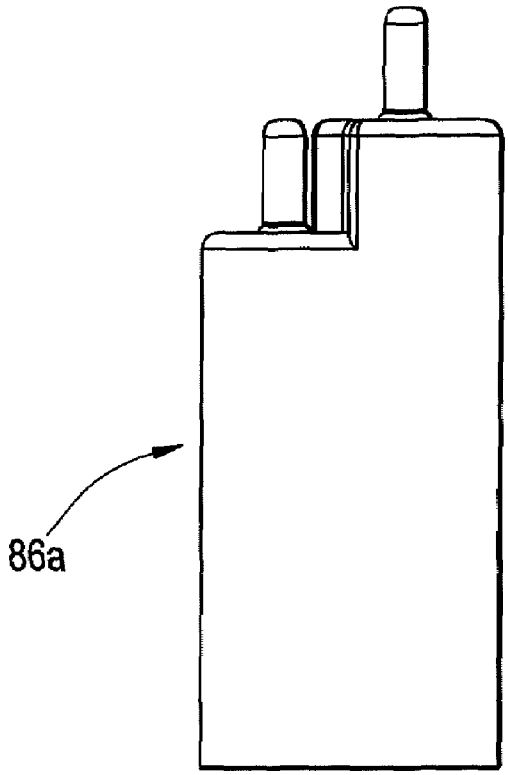
Figure 43:
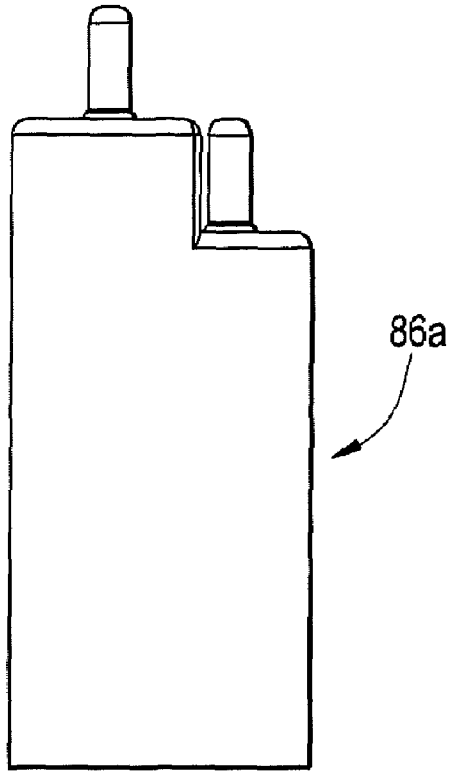
Figure 44:
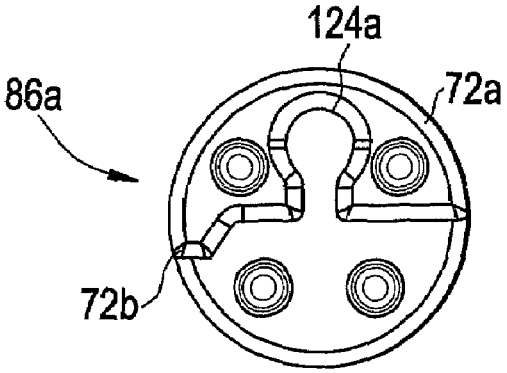
FIG. 44 is a top plan view of the base shown in FIGS. 38-43
Figure 45:
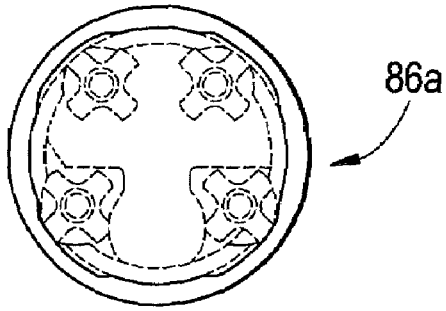
FIG. 45 is a bottom plan view of the base shown in FIGS. 38-44.

Similarly, with reference to FIGS. 25-29 and 30-37, receptacles or bases are shown which are configured to mate with the end caps of FIGS. 20-24 and 38-45, respectively. Thus, receptacle 30' of FIG. 25 includes male extension 132 which is sized and configured to be received by recess 122 in FIG. 20. Receptacle 30*a* of FIGS. 30-37 includes male extension 134*a* which is sized and configured to be received by recess 124*a* in FIG. 38. FIG. 38 also shows how semi-circular bases 72*a* may contain an asymmetrical section 72*b* which may be added to help ensure that unauthorized parts are unable to be used. This is a safety feature because improper wattage lamps or improper lamp designs may commonly be attempted to be substituted so the asymmetrical section 72*b* helps to prevent this unsafe occurrence. The sockets shown on FIGS. 30-37 may be used with the corresponding end caps or bases shown in FIGS. 38-45 or the designs may be exchanged with each other, i.e., the end cap may look like the receptacle or base or vice versa. Receptacle 94' of FIG. 26 includes arcuate shaped male extension 134 which is sized and configured to be received by arcuate recess 124 in FIG. 21. Similarly, receptacle 96' of FIG. 27 includes a rectangular extension 136 which is sized and configured to be received by rectangular recess 126 of FIG. 22, receptacle 98' of FIG. 28 includes a square shaped extension 138 which is sized and configured to be received by squared shaped recess 128 in FIG. 23 and receptacle 100' of FIG. 29 includes a triangular shaped extension 140 which is sized and configured to be received by rectangular shaped recess 130 in FIG. 24.

It will be appreciated that all of the embodiments of the present invention represent an advance over the stepped cap configuration of the aforementioned '527 patent in that the use of the extension (or alternatively the recess) positioned centrally along the barrier wall will provide improved interlocking between the lamp and the receptacle and will also ensure proper orientation of the respective pins within the recesses of the receptacle.

In operation, the cover 26 is removed, and a lamp 32 is inserted into the interior of the sleeve 14 via the aperture in the support wall 18. After insertion, the socket 30 is connected to the pins 48, 50, 52, 54. Then the cover 26 is installed on the housing 12. Electrical wires 66,68 extend exteriorly of the socket to a non-illustrated electrical power supply. A voltage difference across the wires 66,68 is applied to both electrodes 40, 42 causing an electrical discharge within the tube. This discharge causes ultraviolet radiation to be emitted. This radiation passes through the light-transmissive wall of the sleeve 14 to irradiate the water contained in the space 16.

The aforementioned barrier wall 70*a*, 70*b* prevents arcing interiorly of the end cap 44 by physically separating the electrical connections between the pins 48, 50 and the wire conductor, on the one hand, and the electrical connections between the pins 52, 54 and the electrode 40, on the other hand. The pairs of pins are thus effectively isolated.

It will be understood that each of the elements described above, or two or more together, also may find a useful application in other types of constructions differing from the types described above.

Figure 46:
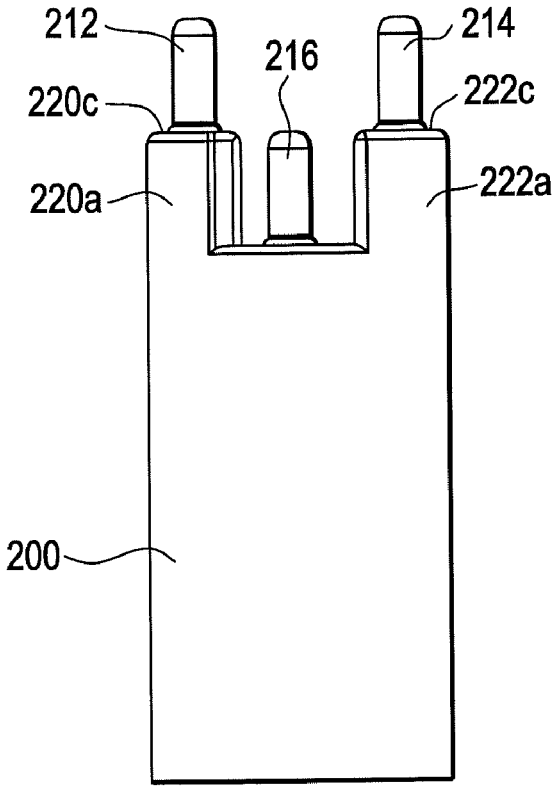
FIGS. 46-48 are various views of a lamp base according to at least an embodiment of the present invention.
Figure 47:
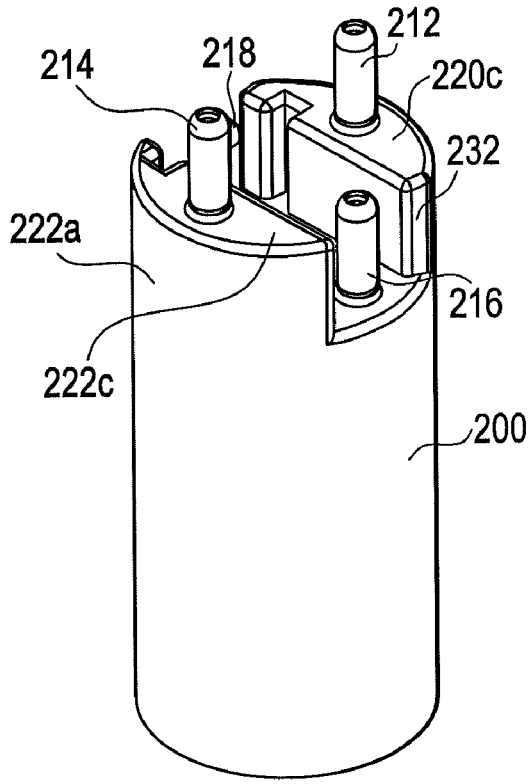
Figure 48:
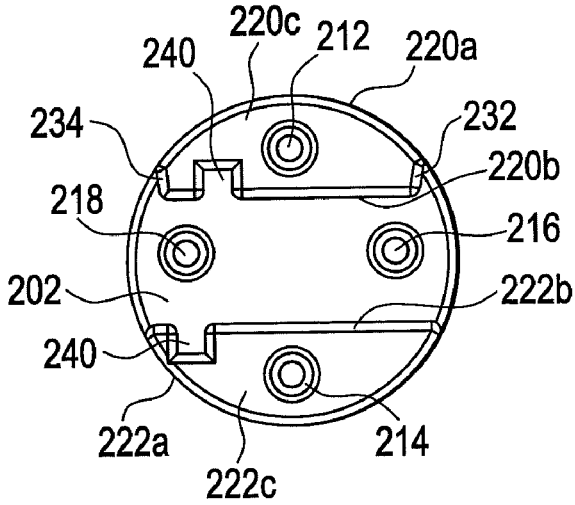

In at least another embodiment of the invention, a lamp base 200 may include at least a first step portion and a second step portion, as seen in FIGS. 46-48.

For example, FIGS. 46-48 illustrate various views of a lamp base 200 according to at least an embodiment of the present invention. The lamp base 200 may be generally cylindrical in shape and has an end surface 202. Additionally, a first step portion and a second step portion may extend outward from end surface 202 of lamp base 200.

As further seen in FIGS. 46-48, the first step portion may include a curved face 220*a*, a flat face 220*b*, and a raised face 220*c*. Similarly, the second step portion may include a curved face 222*a*, a flat face 222*b* and a raised face 222*c*. Curved faces 220*a*, 222*a* and flat faces 220*b*, 222*b* extend perpendicular to the end surface. Raised faces 220*c*, 222*c* are perpendicular to curved faces 220*a*, 222*a* and flat faces 220*b*, 222*b*, respectively.

Lamp base 200 may also include a number of pin connectors. For example, as seen in FIGS. 47-48 (see also FIG. 75), a first upper pin connector 212 extends from the raised face 220*c* of the first step portion, a second upper pin connector 214 extends from the raised face 222*c* of the second step portion, and a first lower pin connector 216 and a second lower pin connector 218 extend from the end surface.

The first and second lower pin connectors 216, 218 may be arranged in a variety of configurations. For example, the first and second lower pin connectors 216, 218 may be arranged symmetrically with respect to a center of the end surface, as seen in FIGS. 85-88. Additionally, the first and second lower pin connectors 216, 218 may be arranged asymmetrically with respect to a center of the end surface, as seen in FIGS. 89-92. These arrangements of the lower pin connectors 216, 218 are helpful in ensuring proper alignment when a lamp base is coupled with a socket, as explained in detail below.

Additionally, key recesses 240 can be provided on the lamp base 200 to help in alignment when coupling with a socket, as explained in more detail below. As seen in FIG. 48, for example, key recesses 240 may be provided in the flat faces 220*b*, 222*b* of the first and second step portions.

Figure 85:
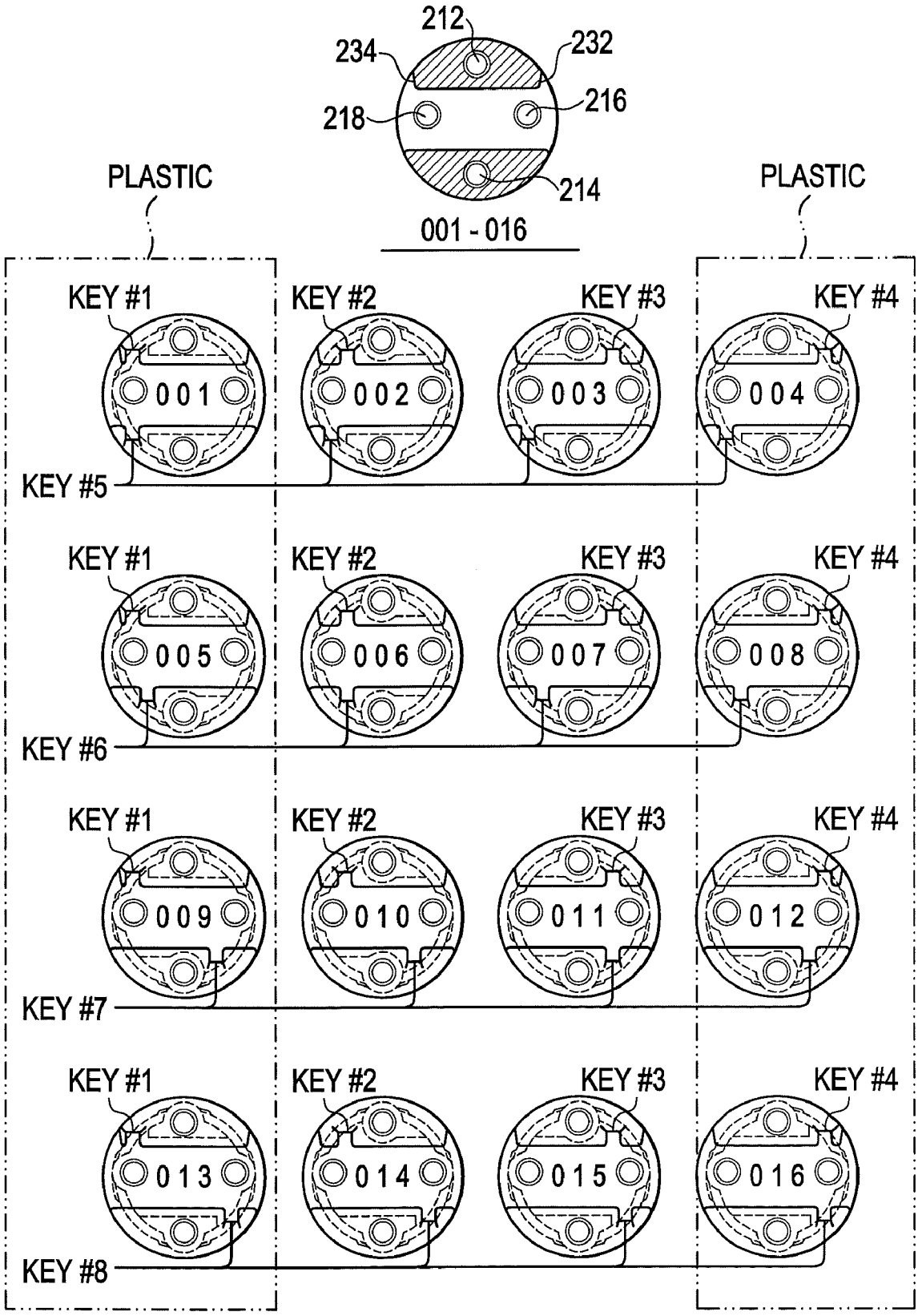
FIGS. 85-92 are plan views show various possible configurations of pin connectors, truncated parts, and keys according to at least some embodiments of the present invention.

There are many different possible configurations of key recesses, as seen in FIG. 85, for example. FIG. 85 how a key recess can be found at one of at least four positions (key #1, key #2, key #3, key #4) in the flat face of the step portion. Additionally, FIG. 85 shows how a key recess can be found at one of at least four positions (key #5, key #6, key #7, key #8). It is important to note that the keys can be placed independent from each other, and thus many possible combinations of key positions can be achieved. It will also be appreciated that the key positions are not limited to only the positions shown in FIG. 85, and that other suitable positions are also possible.

Figure 86:
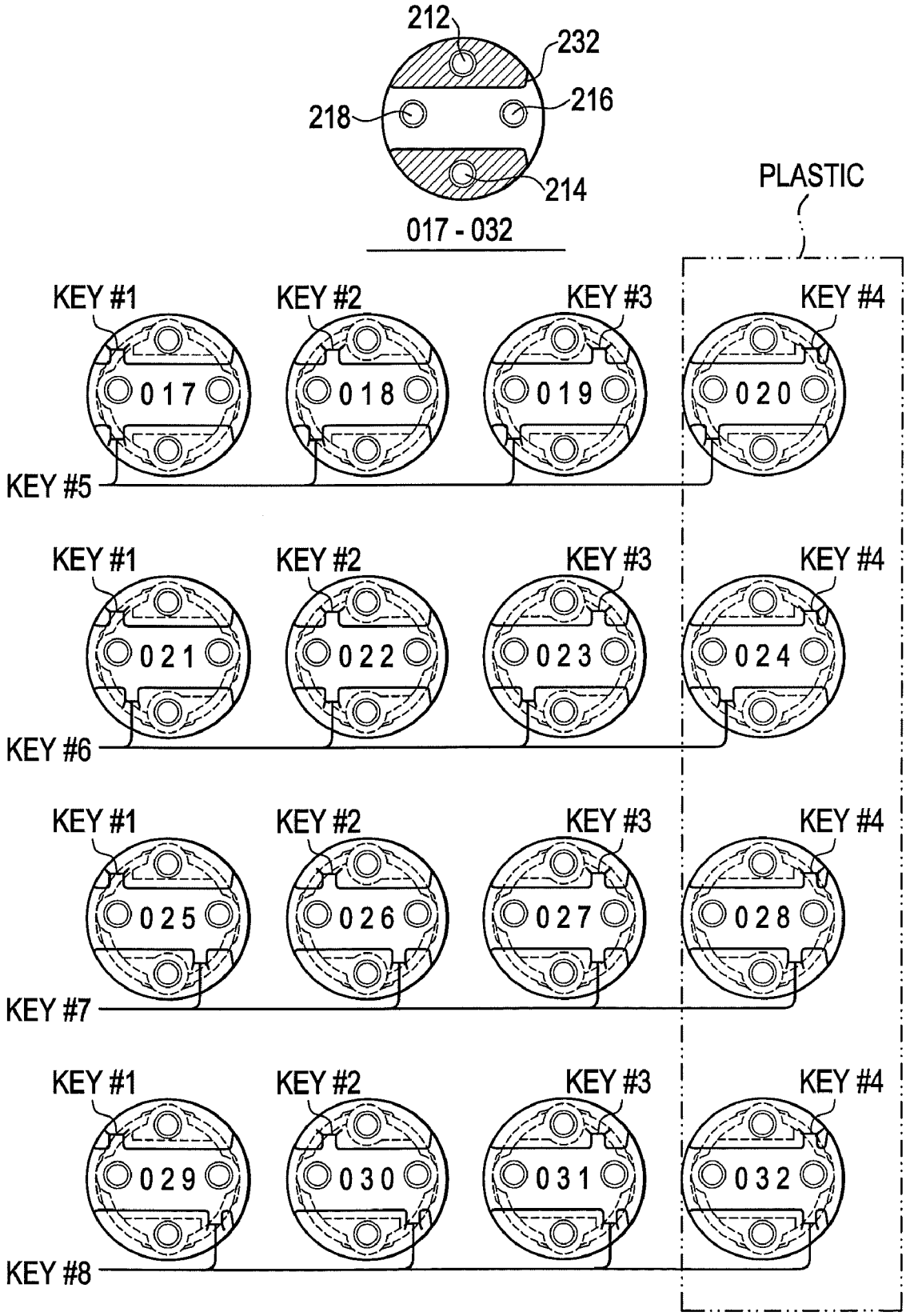
Figure 87:
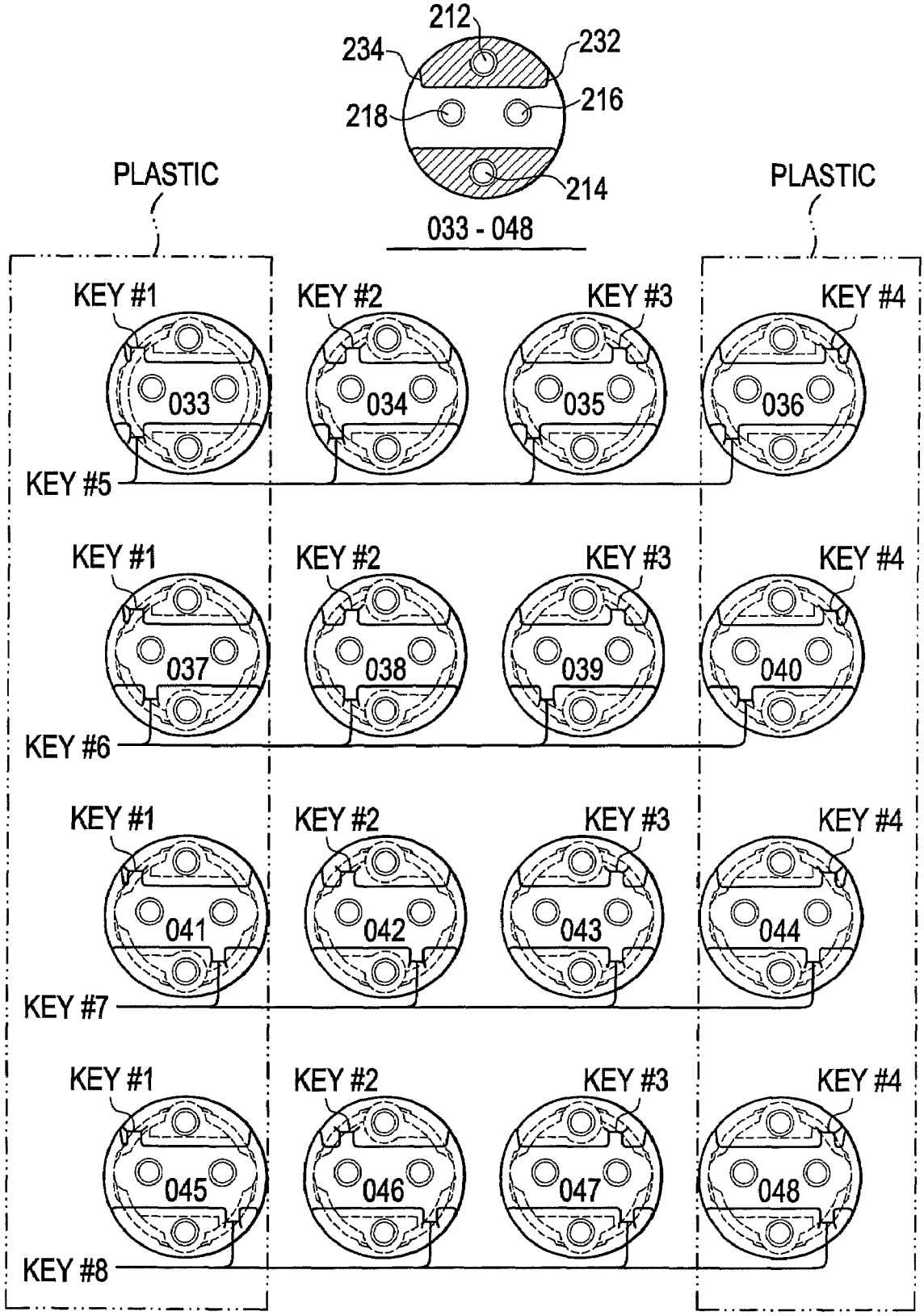
Figure 88:
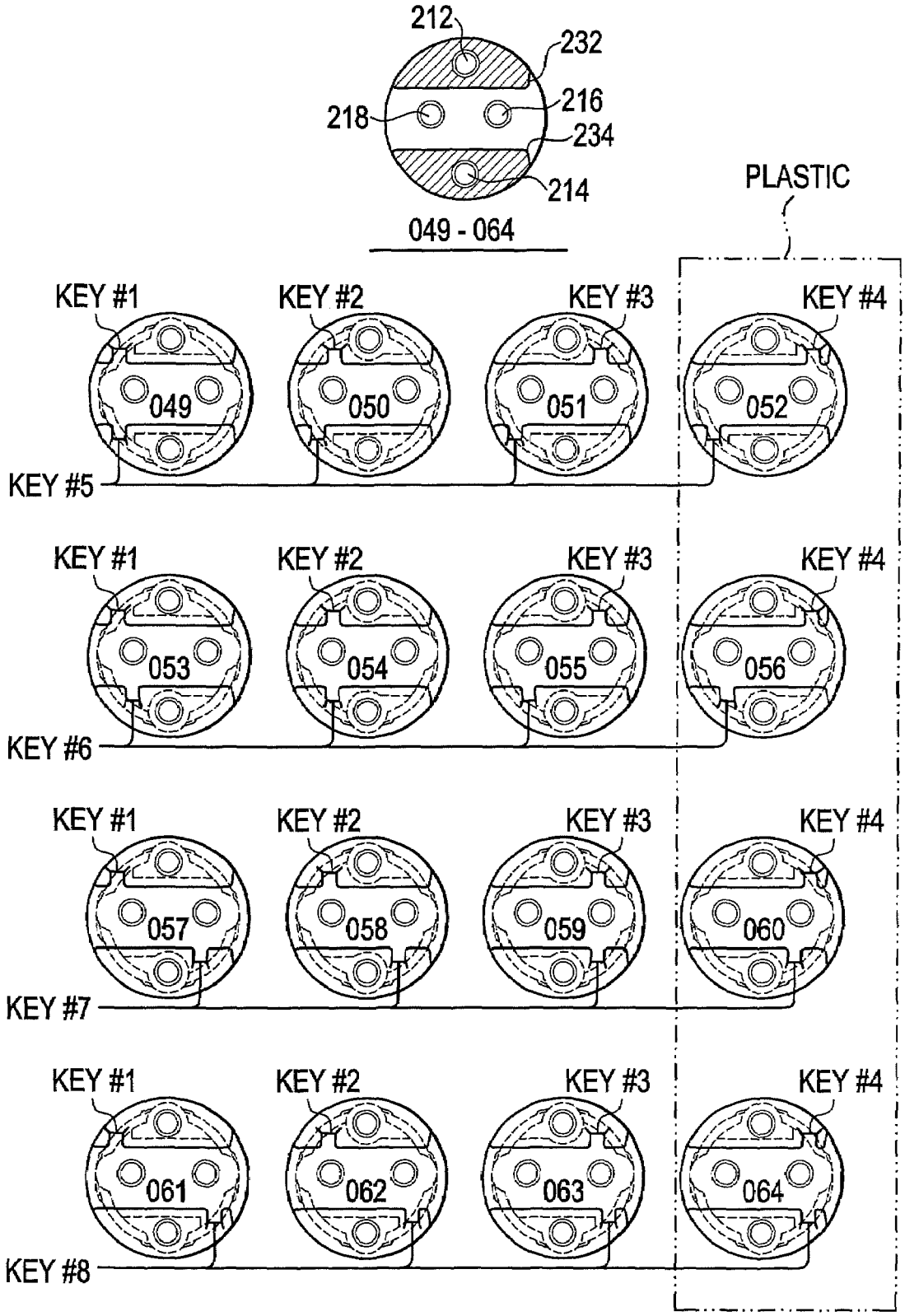
Figure 89:
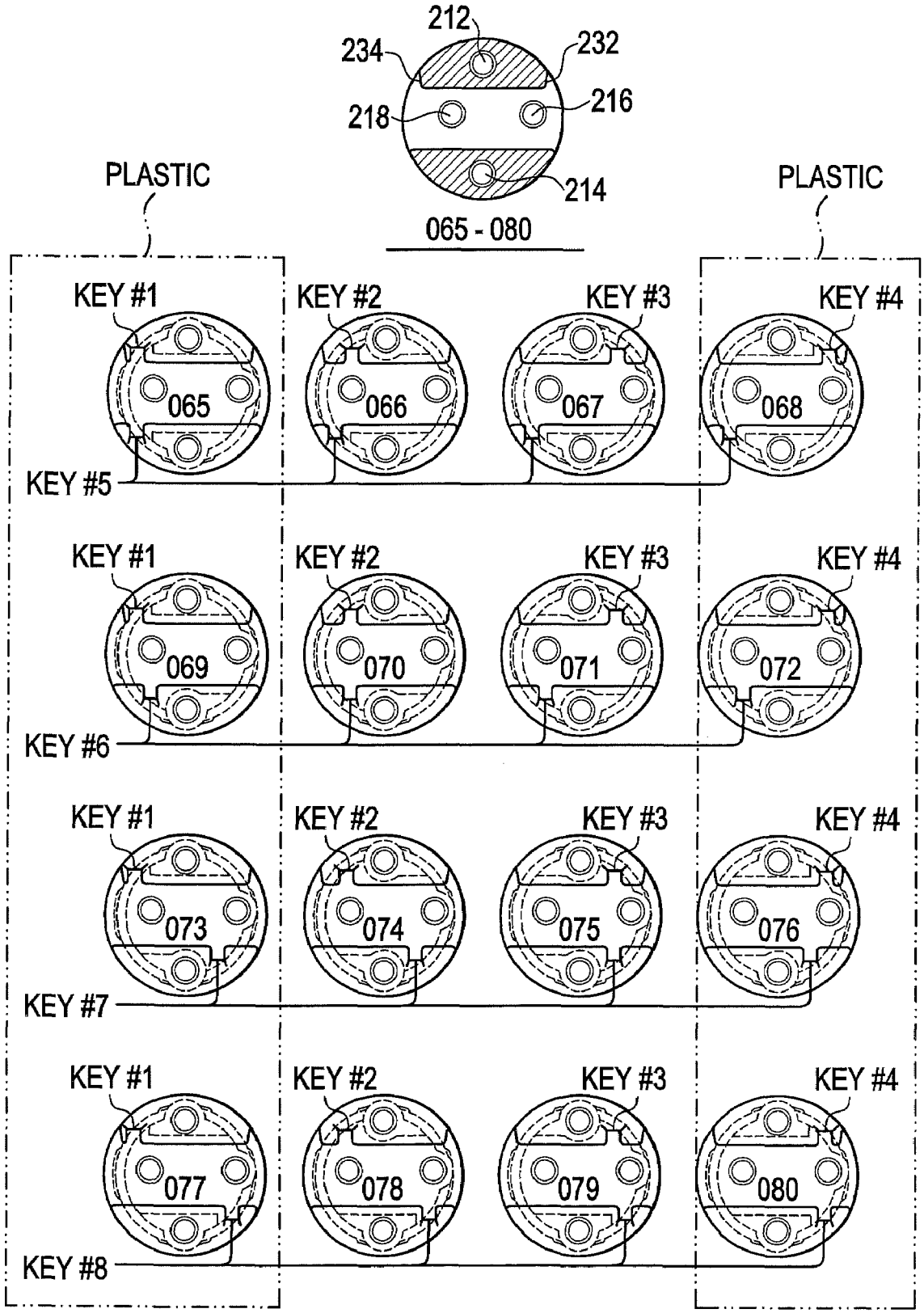
Figure 90:
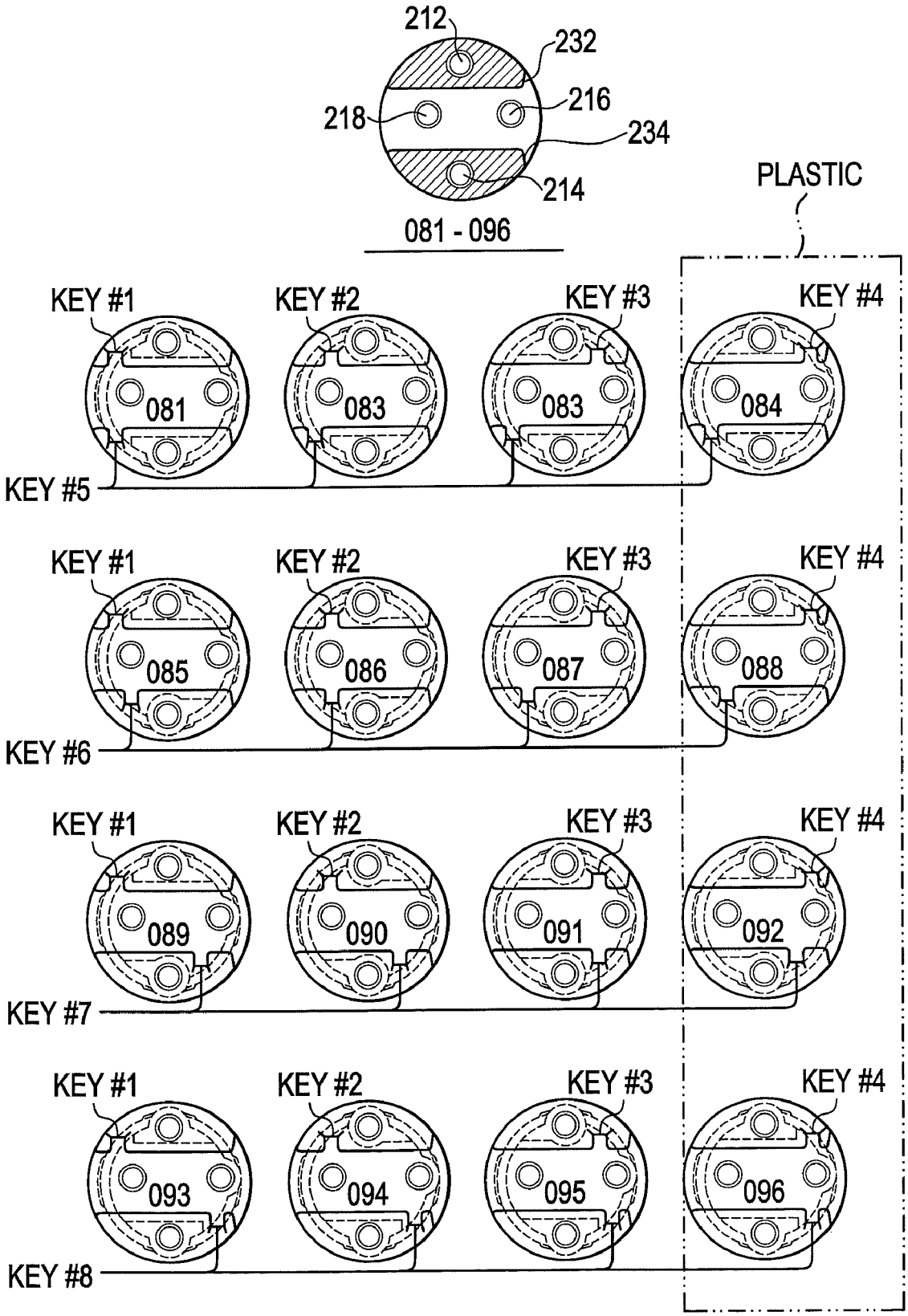
Figure 91:
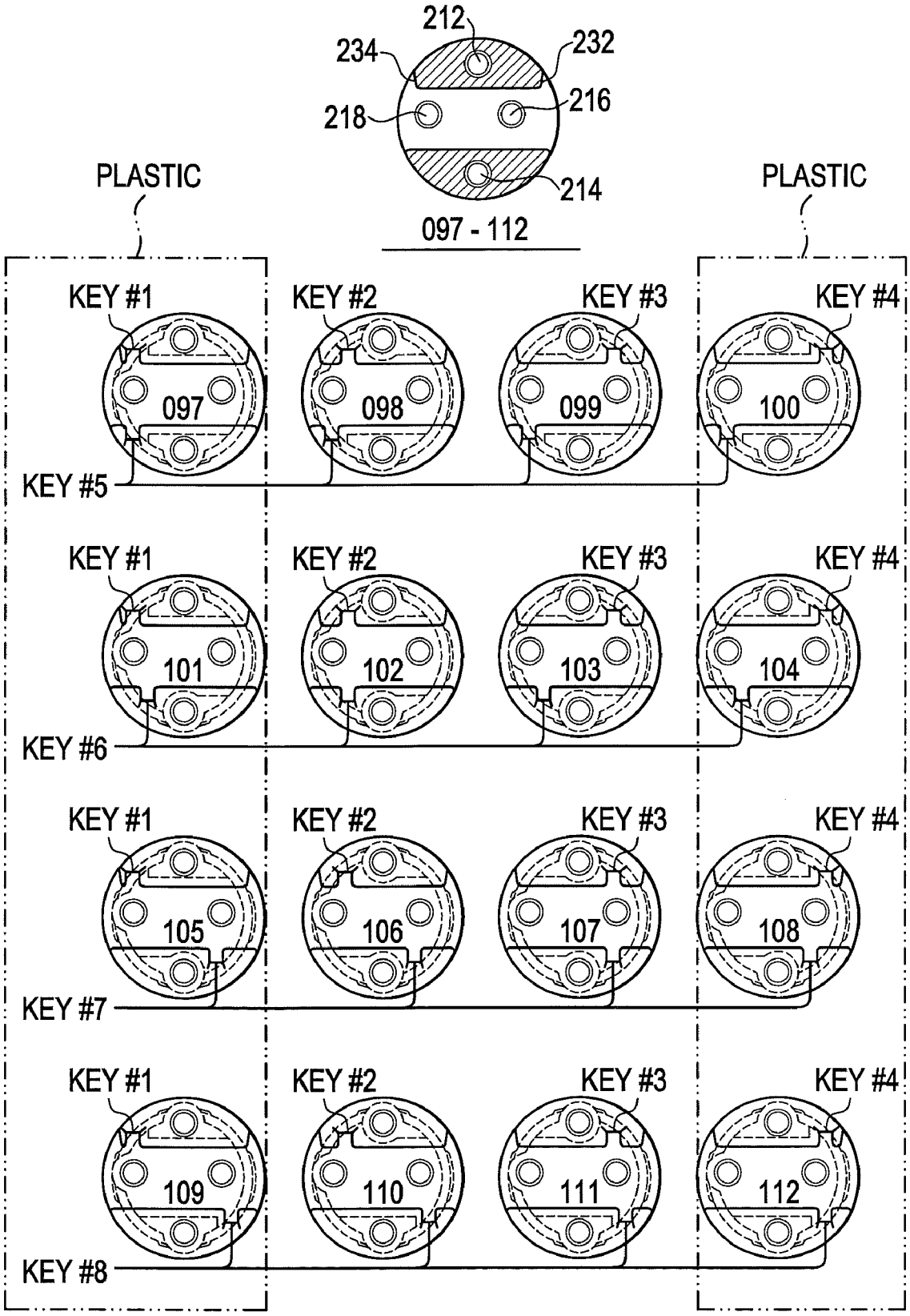
Figure 92:
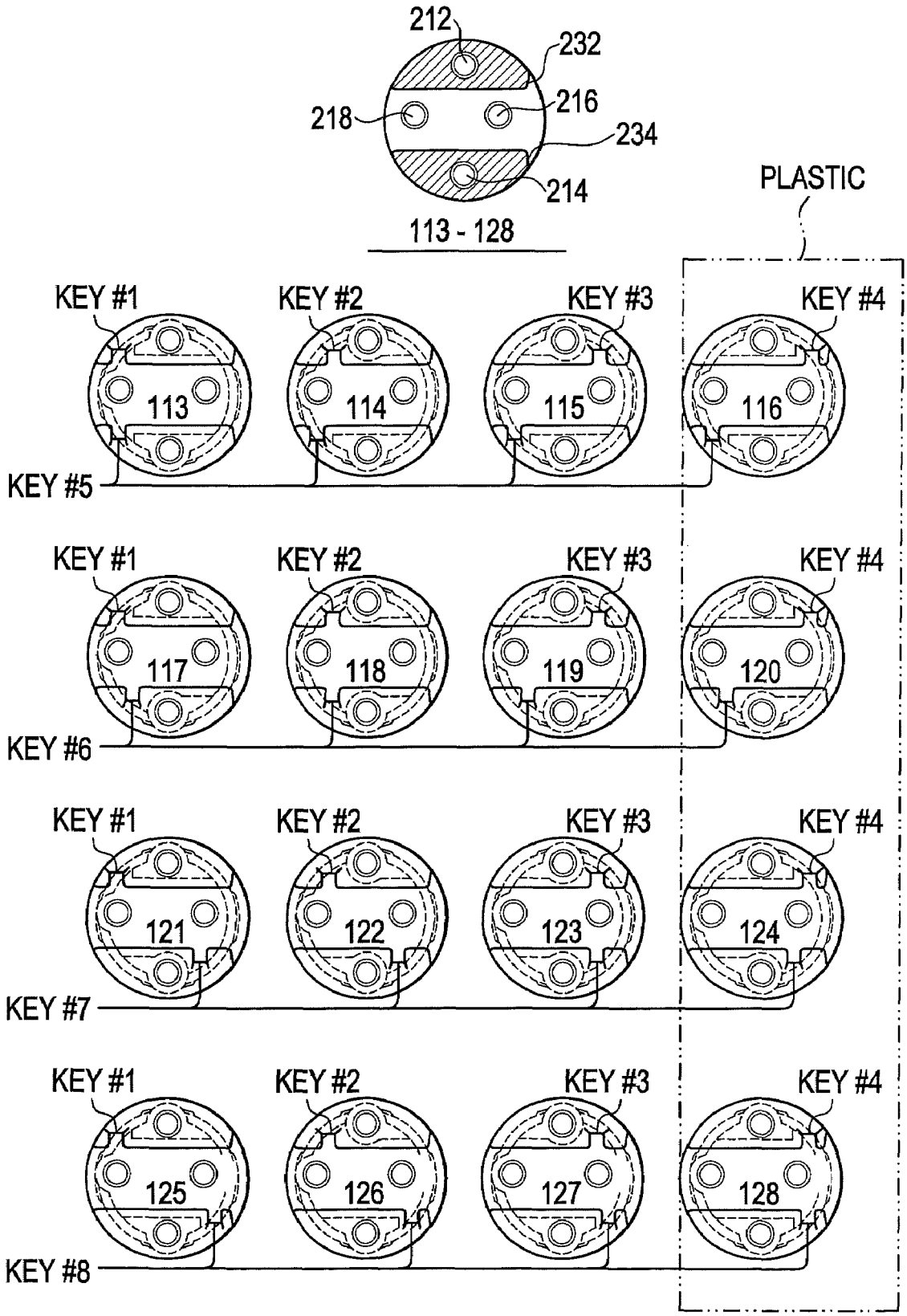
Figure 93:
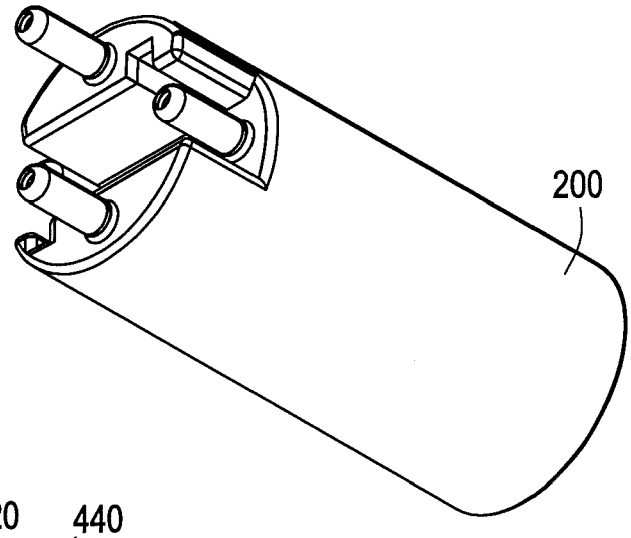
FIG. 93 shows a lamp base according to at least an embodiment of the present invention.

As seen in FIG. 48, the first step portion may also include a first truncated portion 232 and a second truncated portion 234. When compared with the second step portion, truncated portions 232, 234 are flat surfaces where it appears that the step portion has been truncated, or "cut off." In at least the embodiment shown in FIG. 48, the truncated portions 232, 234 are provided at a first and second end of the first step portion. However, other configurations are possible. For example, as seen in FIG. 86, the first truncated portion 232 may be provided at a first end of a first step portion, and a second truncated portion 234 may be provided at a first end of a second truncated portion. The truncated portions help to ensure proper alignment when a lamp base is coupled with a socket, as explained in more detail below.

Figure 49:
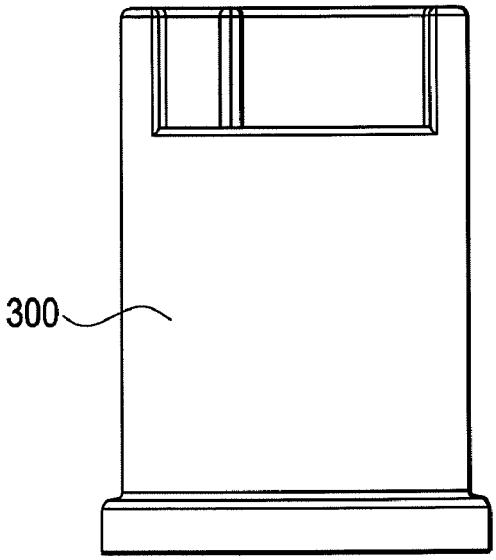
FIGS. 49-51 are various views of a socket according to at least an embodiment of the present invention.
Figure 50:
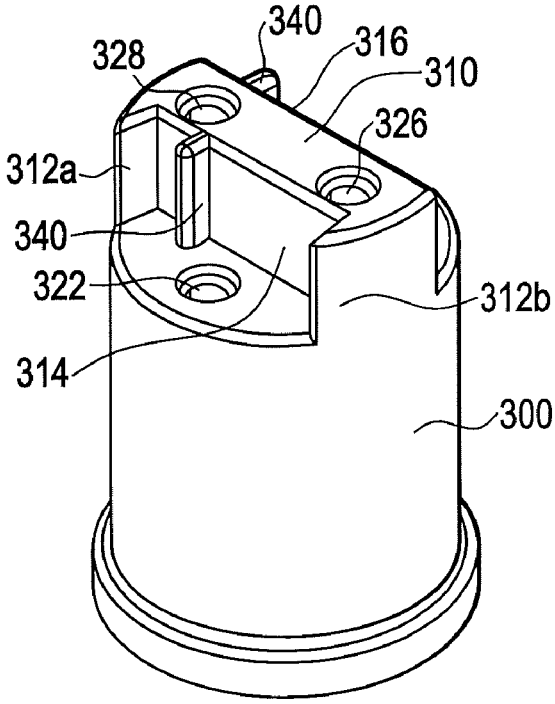
Figure 51:
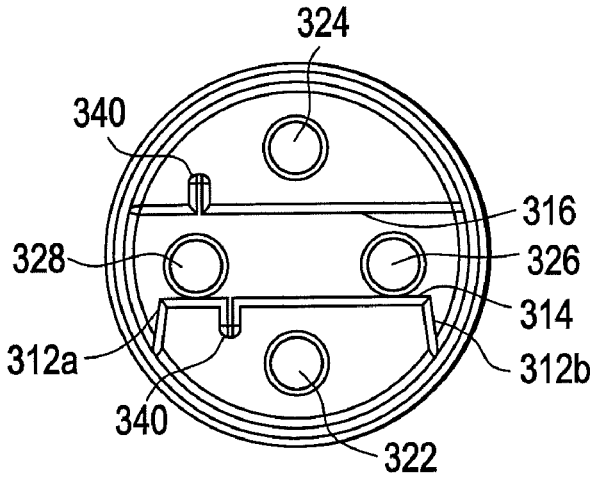
Figure 55:
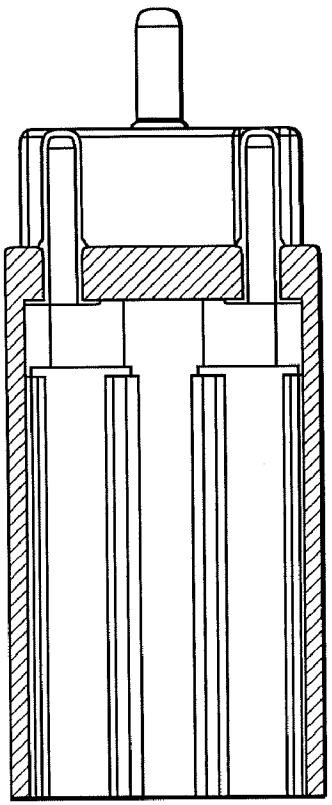
FIGS. 52-55 are various views of a lamp base according to at least an embodiment of the present invention.
Figure 54:
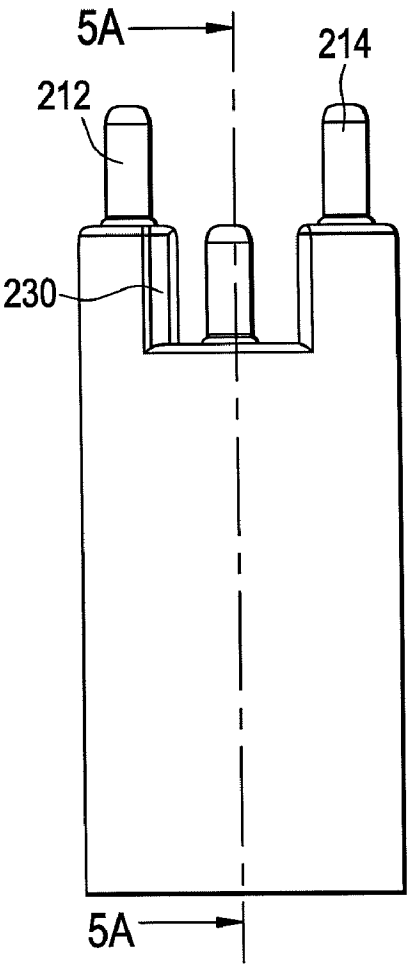
Figure 53:
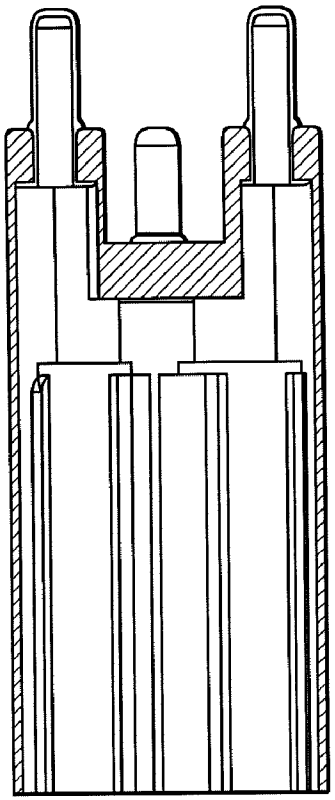
Figure 52:
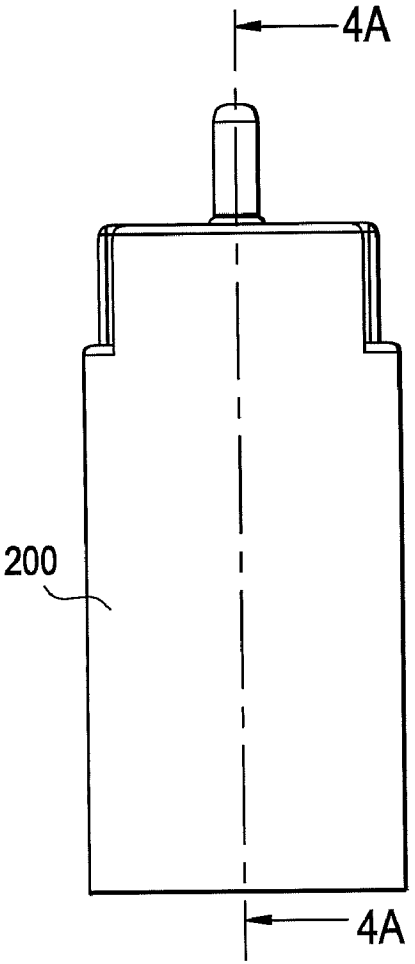
Figure 56:
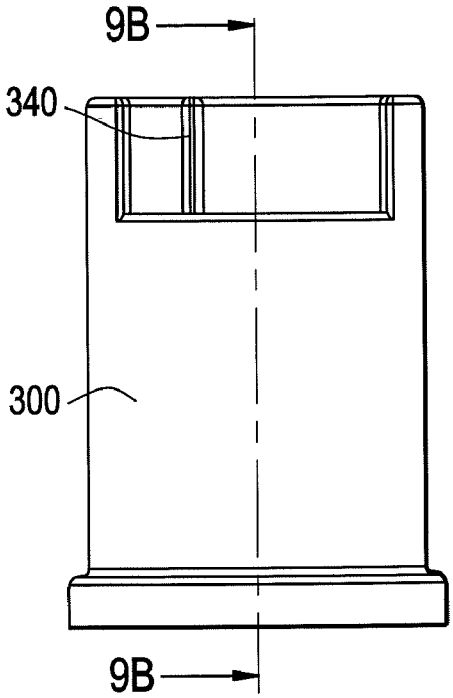
FIGS. 56-59 are various views of a socket according to at least an embodiment of the present invention.
Figure 57:
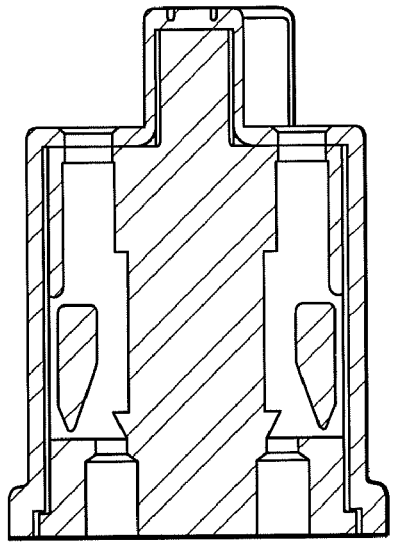
Figure 58:
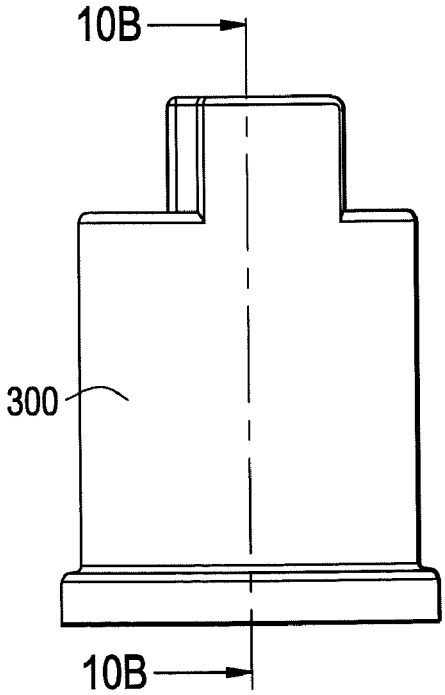
Figure 59:
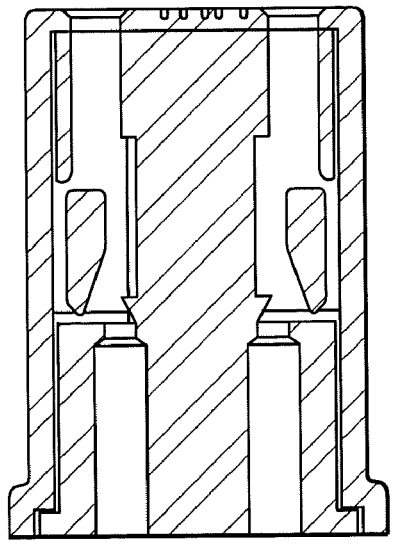
Figure 60:
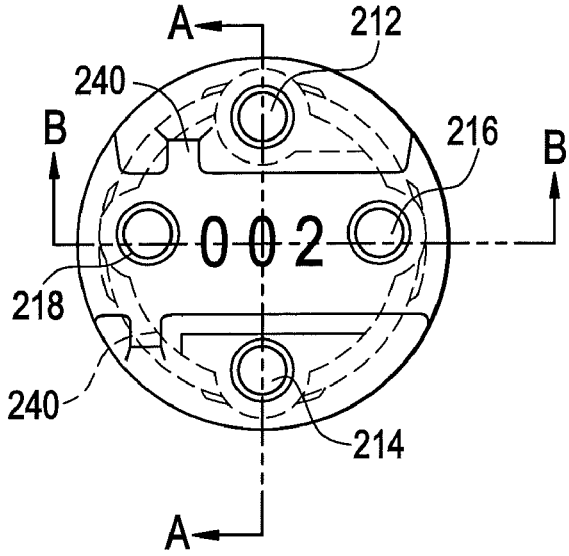
FIGS. 60-64 are various views of a lamp base according to at least an embodiment of the present invention.
Figure 61:
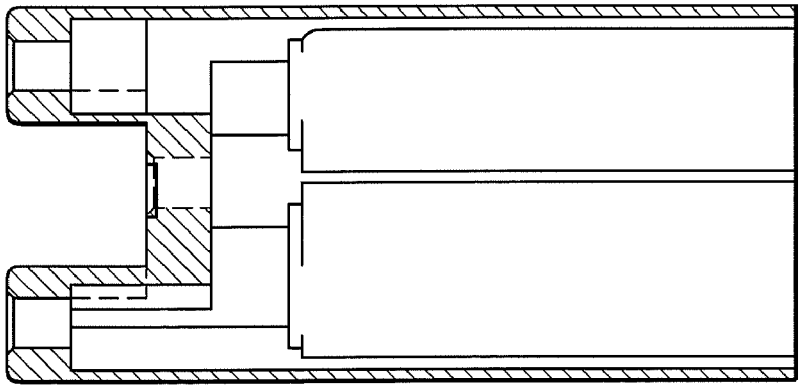
Figure 62:
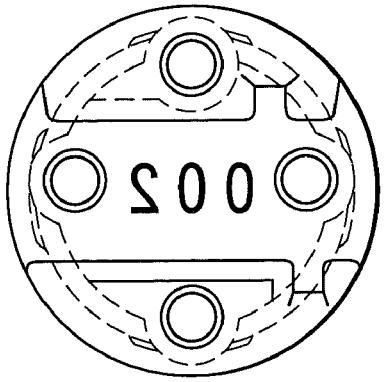
Figure 63:
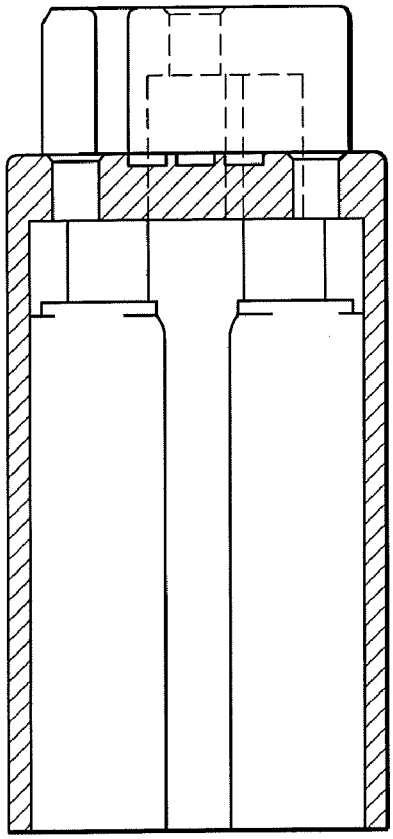
Figure 64:
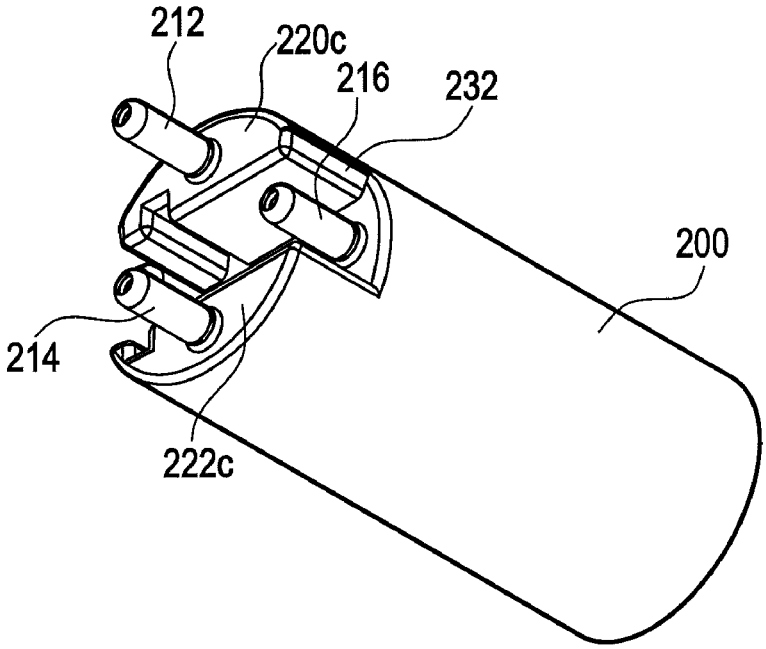
Figure 65:
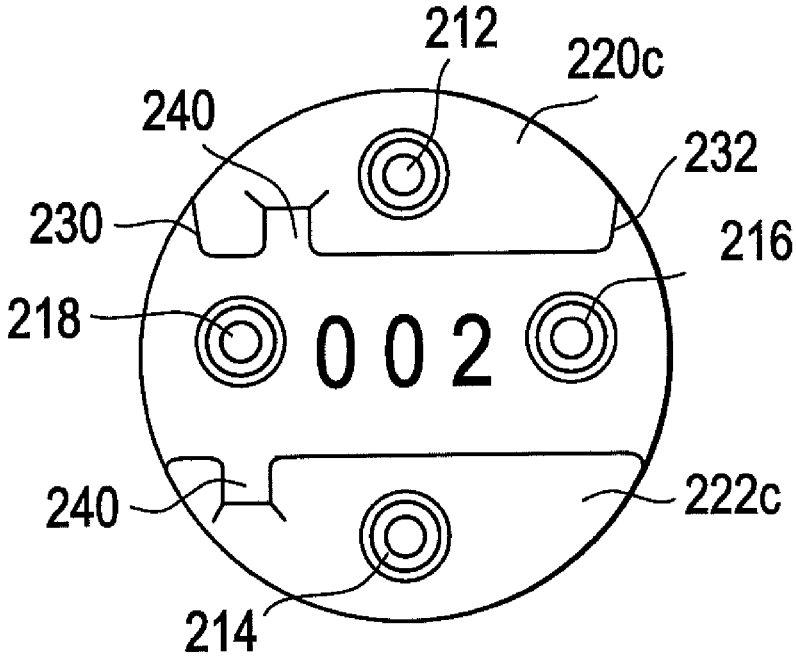
FIGS. 65-68 are various views of a lamp base according to at least an embodiment of the present invention.
Figure 66:
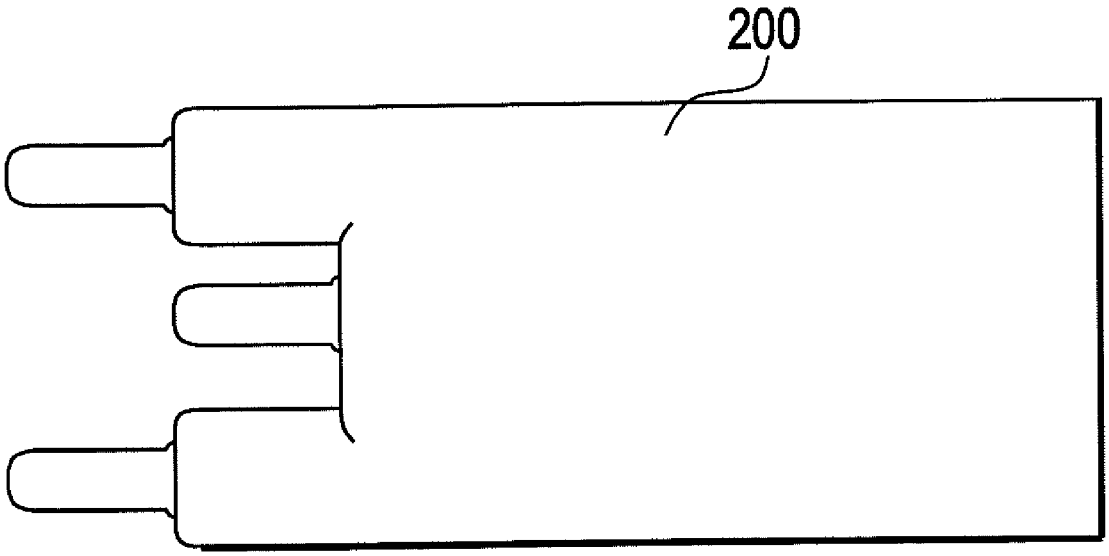
Figure 67:
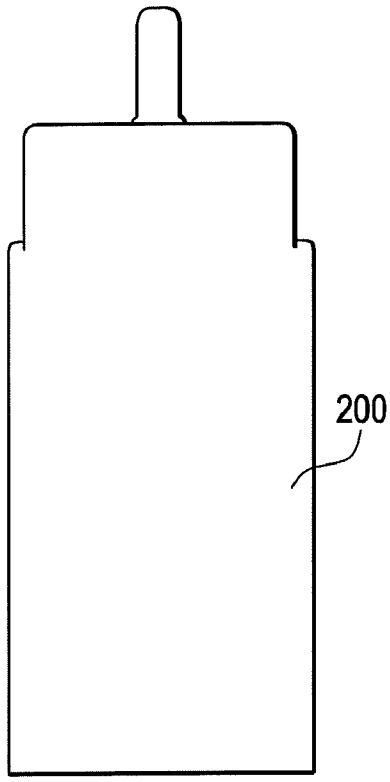
Figure 68:
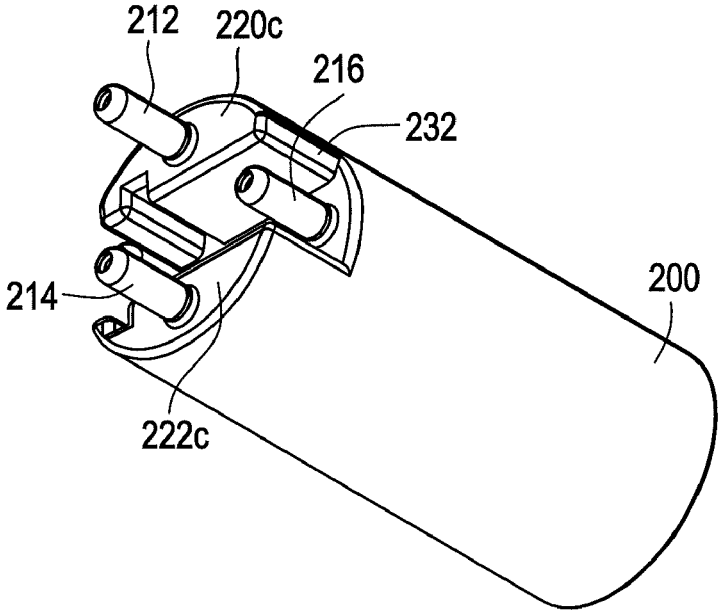
Figure 69:
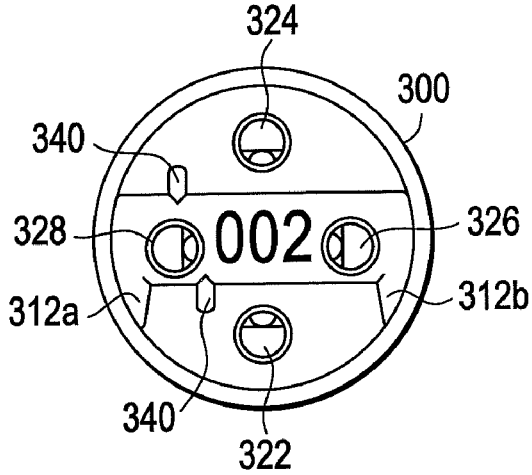
FIGS. 69-73 are various views of a socket according to at least an embodiment of the present invention.
Figure 70:
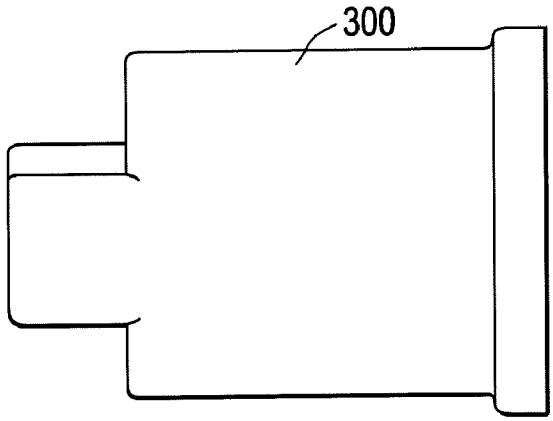
Figure 71:
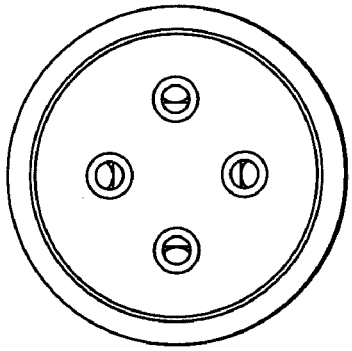
Figure 72:
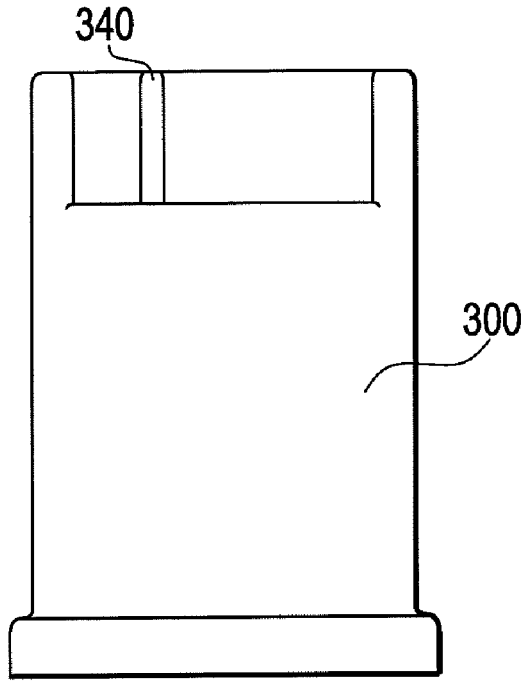
Figure 73:
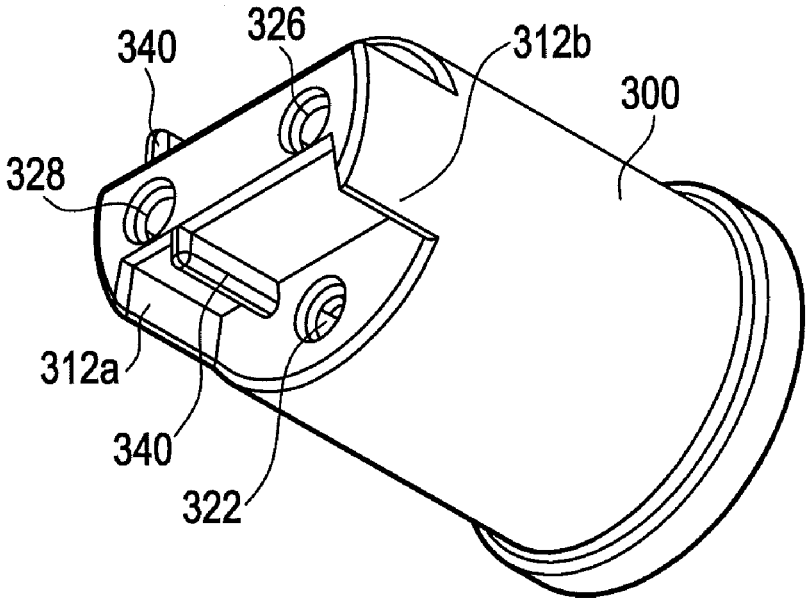

FIGS. 49-51 illustrate at least one possible embodiment of a socket 300. The socket 300 may be generally cylindrical in shape and has an end surface. Additionally, a central step portion 310 extends perpendicular to the end surface of socket 300. Central step portion 310 may include a first flat face 314 extending perpendicular to the end surface and a second flat face 316 extending perpendicular to the end surface.

Additionally, as seen in FIGS. 50 and 51, socket 300 may include a first upper connector 326 provided within a recess formed in the central step portion 310 and a second upper connector 328 provided within a recess formed in the central step portion 310. Socket 300 may also include a first lower connector 322 provided within a recess formed in the end surface, and a second lower connector 324 provided within a recess formed in the end surface. The first and second upper connectors 326, 328 may be positioned either symmetrically or asymmetrically with respect to a center of the end surface of the socket 300.

FIGS. 50-51 also illustrate that the socket 300 may include key protrusions 340 protruding out from the first flat face 314 and the second flat face 316. These key protrusions 340 can be positioned in a wide variety of configurations, complementing the wide variety of configurations possible for key recesses 240.

Additionally, FIGS. 50-51 show that socket 300 may also include a first tapered portion 312*a* and a second tapered portion 312*b*. The tapered portions 312*a*, 312*b* may extend out from the first and second ends of first flat face 314, as seen in FIG. 51, for example, or a first tapered portion 312*a* may extend out from a first end of first flat face 314 while the second tapered portion 312*b* extends out from a first end of second flat face 316.

FIGS. 52-73 and 76-93 show various additional views of at least some possible embodiments and configurations of lamp bases 200 and sockets 300.

Figure 75:
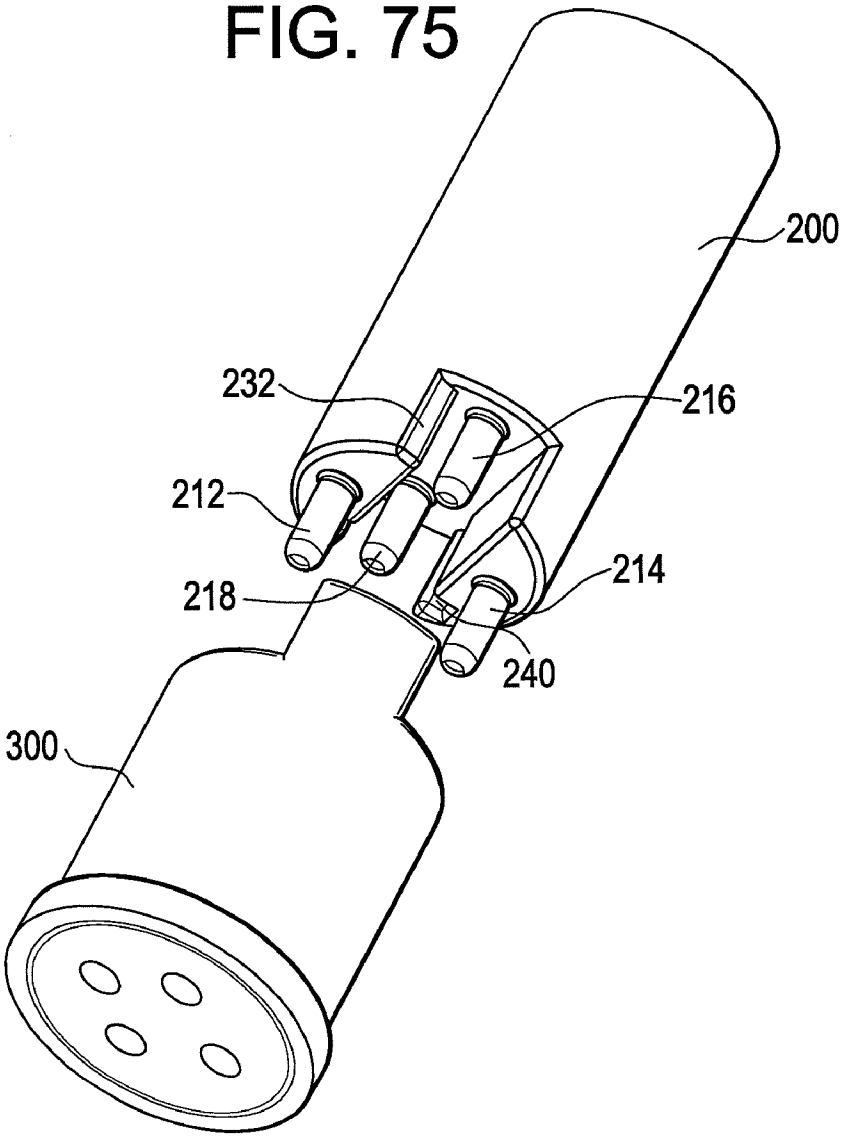
FIGS. 74-75 are perspective views of a lamp base and socket assembly according to at least an embodiment of the present invention.
Figure 74:
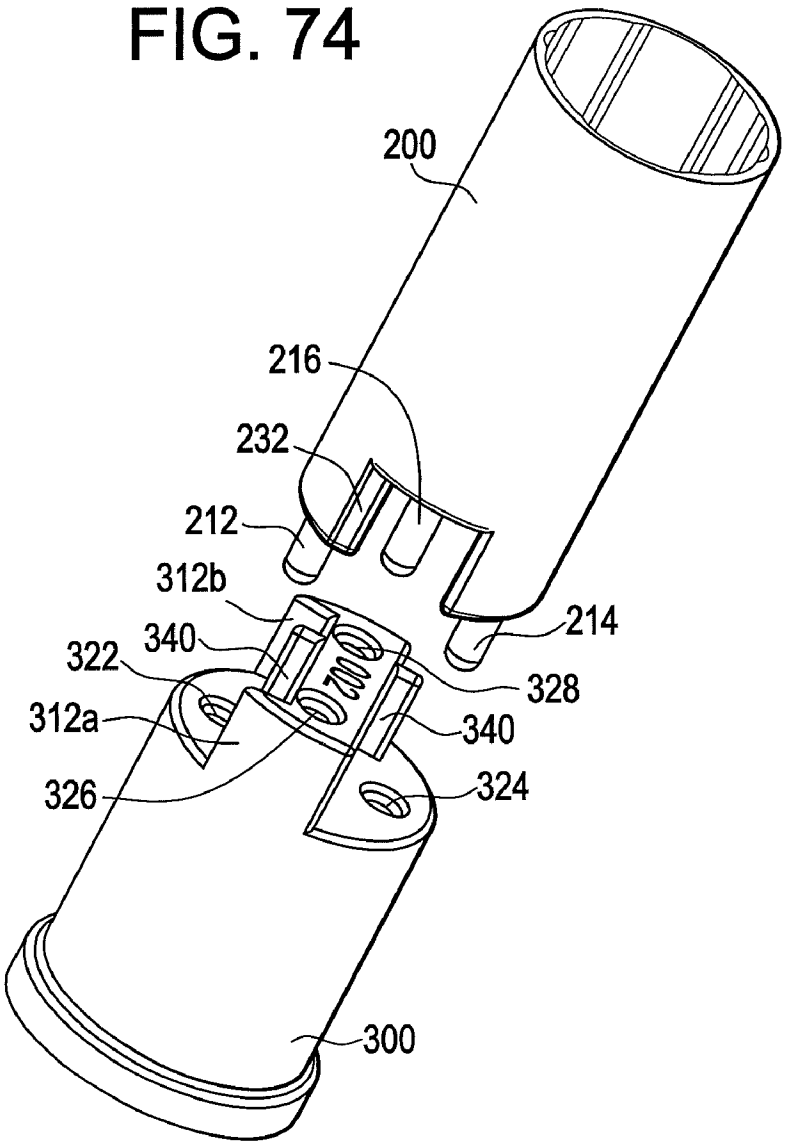
Figure 76:
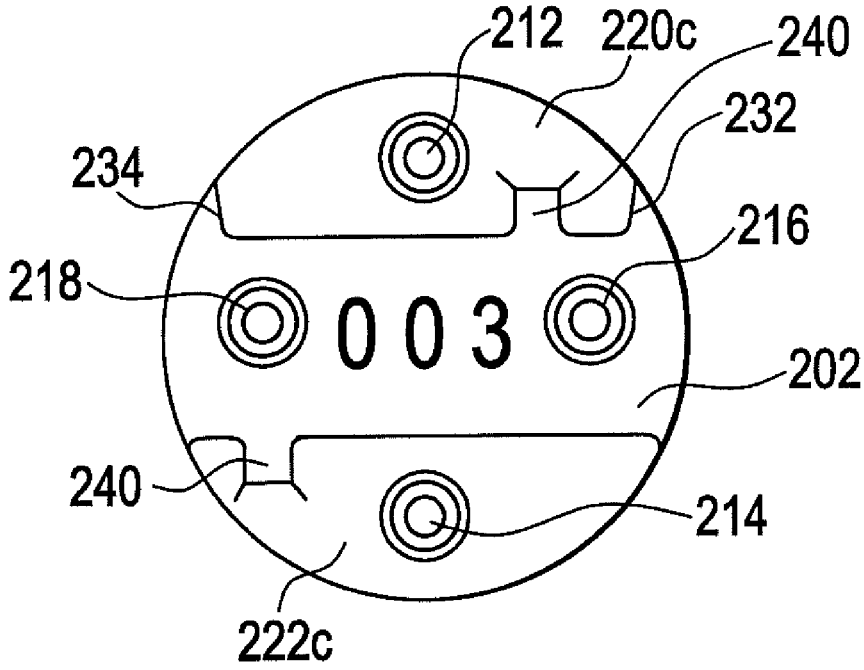
FIGS. 76-79 are various views of a lamp base according to at least an embodiment of the present invention.
Figure 77:
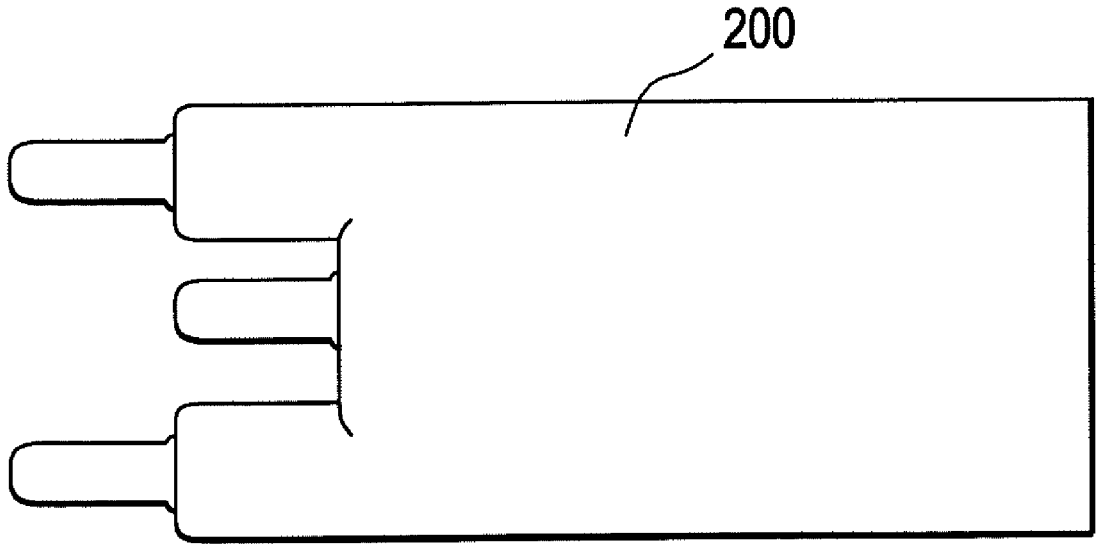
Figure 78:
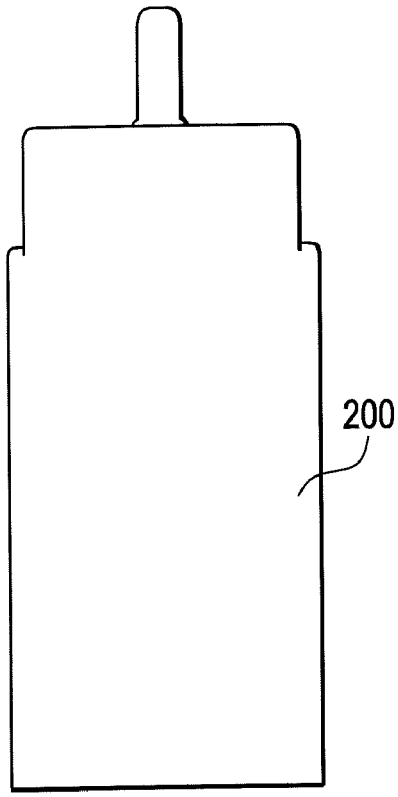
Figure 79:
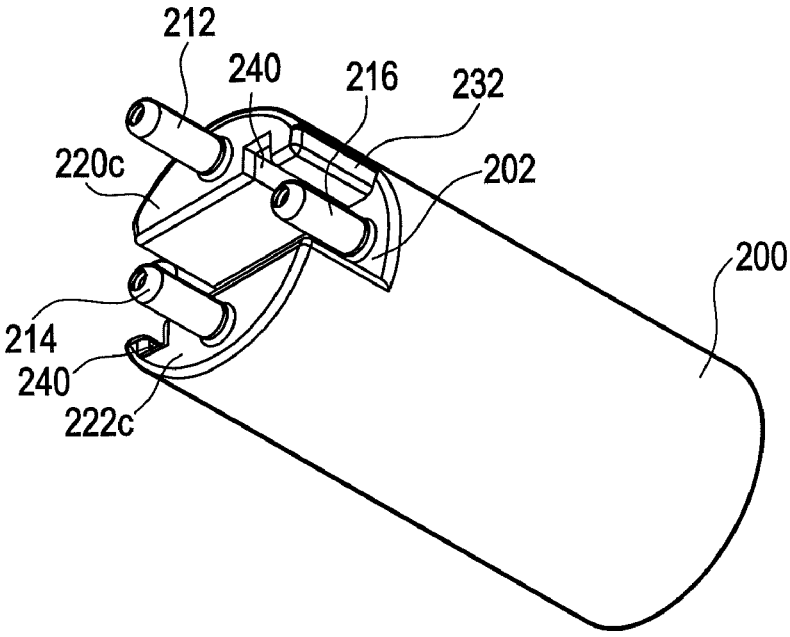
Figure 80:
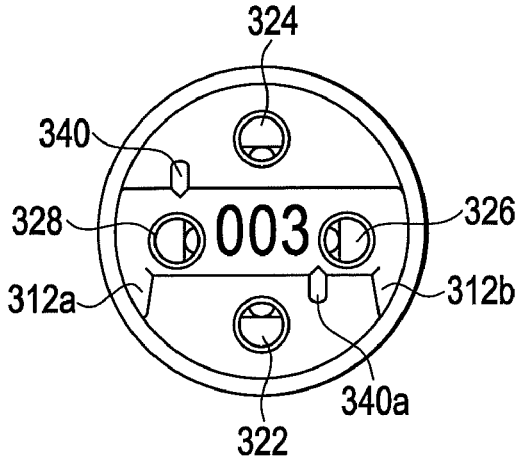
FIGS. 80-84 are various views of a socket according to at least an embodiment of the present invention.
Figure 81:
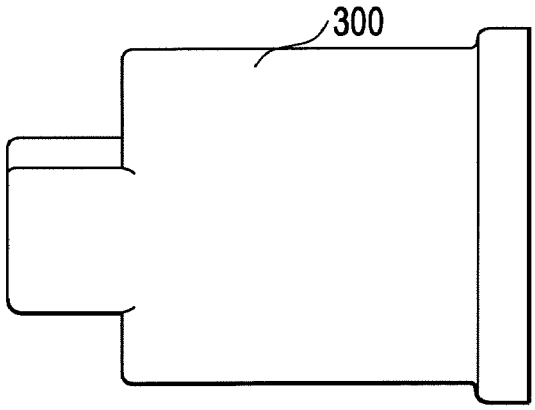
Figure 82:
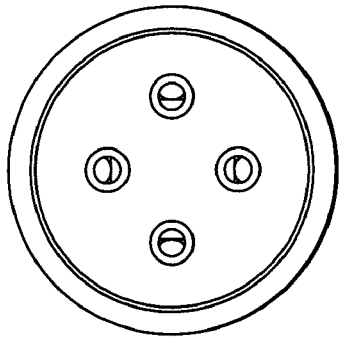
Figure 83:
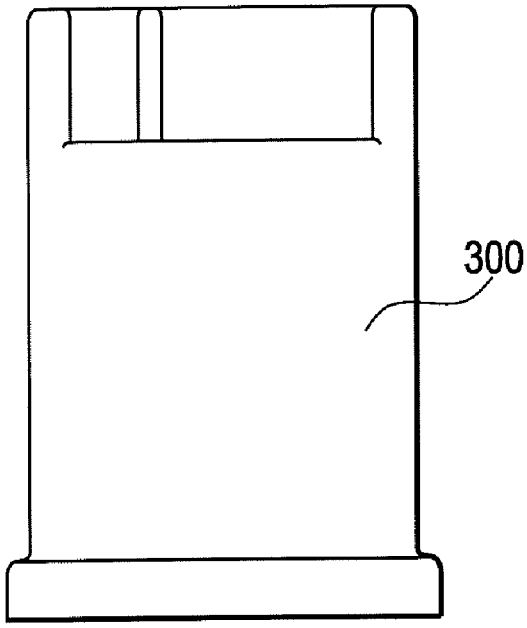
Figure 84:
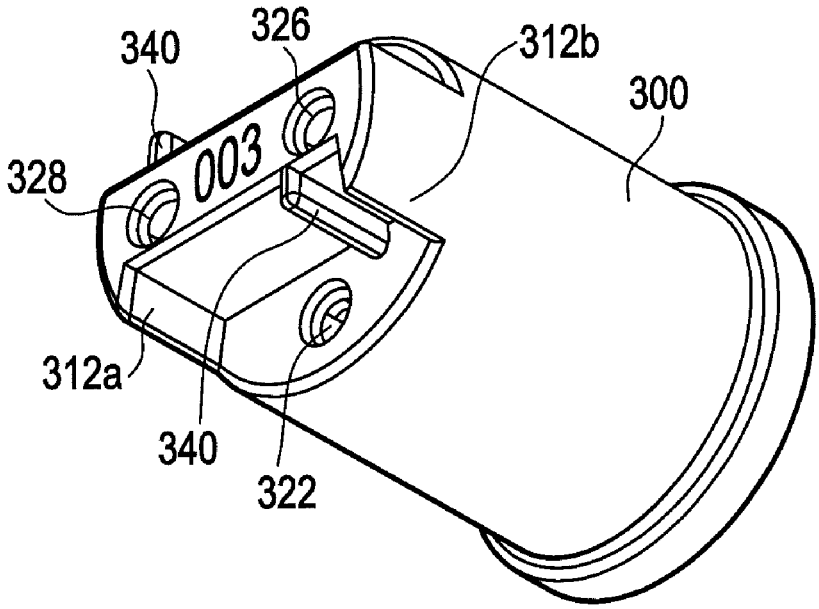

FIGS. 74 and 75 show how a lamp base 200 and a socket 300 according to at least an embodiment of the present invention can couple with each other. Lamp base 200 and socket 300 are structured such that first upper pin connector 212 couples with first lower connector 322, second upper pin connector 214 couples with second lower pin connector 324, first lower pin connector 216 couples with first upper connector 326, and second lower pin connector 218 couples with second upper connector 328.

Additionally, it is seen in FIGS. 74 and 75 that the key recesses 240 of lamp base 200 are structured to align with the key protrusions 340 of the socket 300 when the lamp base and the socket are coupled. In other words, when lamp base 200 is coupled with socket 300 in the proper alignment, key protrusions 340 will slide into key recesses 240. If lamp base 200 is misaligned with socket 300, then the key protrusions 340 will not align with the key recess 240.

Additionally, as another method to ensure proper alignment, it is seen from FIGS. 74 and 75 that first tapered portion 312*a* will align with first truncated portion 232, and second tapered portion 312*b* will align with the second truncated portion 234.

As noted above, there are many alignment features designed to ensure that the lamp base 200 is properly aligned with socket 300 when they are coupled, for example, the key protrusions 340 and key recesses 240 and the truncated portions 232, 234 and tapered portions 312*a*, 312*b*. These alignment features result in significant and non-trivial benefits over conventional devices.

For example, it will be appreciated that the alignment features described above can ensure that there is only one possible way for a lamp base to fit into the socket. In other words, the alignment features ensure that the first upper pin connector 212 will always couple with the first lower connector 322, the second upper pin connector 214 will always couple with the second lower connector 324, etc. This is an important safety feature because it prevents the pin connectors from mistakenly being connected to the wrong polarity of a power source, for example, which could damage the lamp. Thus, the alignment features described above can help to prevent damage to lamps by ensuring proper coupling.

Additionally, the alignment features described above can help to ensure that a lamp is only coupled with an appropriate socket. For example, an appropriate socket may have a given configuration of key protrusions 340 and/or tapered portions 312*a*, 312*b*, and unless the lamp base is a properly corresponding lamp base that has complementary key recesses 240 and/or truncated portions 232, 234, the lamp base cannot be coupled to the socket.

Additionally, these features provide important safety benefits as well. For example, if connector pins are improperly connected to the wrong polarities, sparks can be generated that pose a fire risk, or the user may be exposed to electric shock. Each of the alignment features above helps to ensure proper coupling of lamp bases and sockets, thus reducing the risk of these hazards and protecting the safety of the user.

Figure 94:
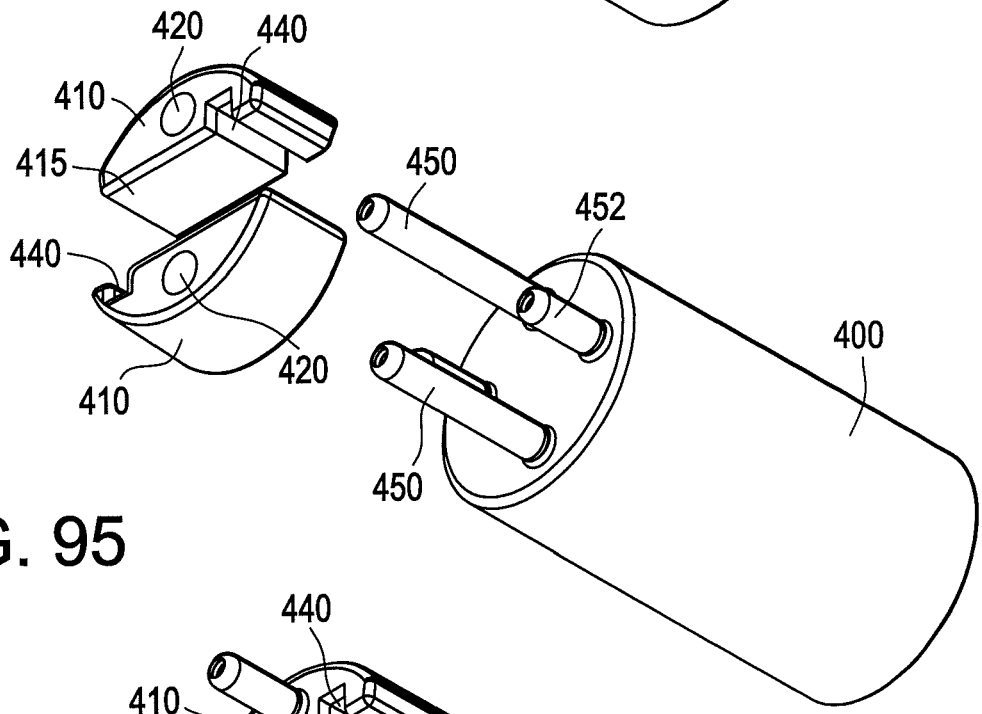
FIG. 94 is an exploded perspective view of a lamp base and an adapter according to at least an embodiment of the present invention.
Figure 95:
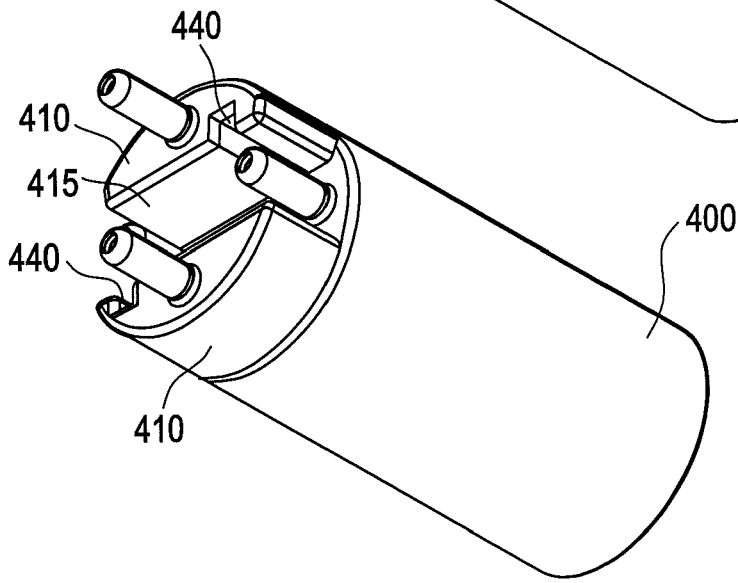
FIG. 95 is an assembled perspective view of a lamp base and an adapter according to at least an embodiment of the present invention.

Additionally, in at least another embodiment of the present invention, as seen in FIGS. 94 and 95, an adaptor may be provided so that lamp bases may be retrofitted to couple with new sockets. For example, in FIG. 94, lamp base 400 is a simple lamp base with four pin connectors 450, 452. Adaptor 410 can be fitted onto the end of lamp base 400. Adaptor 410 has a flat face 415, and end face 410 that is perpendicular to the flat face 415, and a key recess 440. After the adaptor 410 is fitted to lamp base 400, adaptor 410 simulates a step portion and pin connector 450 extends through adaptor 410. A second adaptor 410 can be also be fitted so that the lamp base 400 has two step portions. The key recesses 440 on the adaptors can be configured to match the key protrusions of a corresponding socket. In this way, it is possible to achieve the benefits of ensuring proper alignment when coupling a lamp base and socket, as described above, by simply upgrading already existing lamp bases with adaptors 410.

While the invention has been illustrated and described as embodied in an ultraviolet lamp for use in water or other liquid or air purifiers, it is not intended to be limited to the details shown, since various modifications and structural changes may be made without departing in any way from the spirit of the present invention. Thus, the lamp of this invention need not be limited to lamps that emit ultraviolet radiation, nor be limited to use in a water purifier.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A lamp base to be fitted on an end of a lamp bulb and designed to couple with a socket, the lamp base comprising:
- a cylindrical body having an end surface;
- a first step portion and a second step portion, each comprising a flat face extending perpendicular to the end surface, and a raised face that is perpendicular to the flat face;
- a first upper pin connector provided on the raised face of the first step portion and extending perpendicular to the first step portion;
- a second upper pin connector provided on the raised face of the second step portion and extending perpendicular to the first step portion; and
- a first and second lower pin connector provided on the end surface and extending perpendicular to the end surface;
- wherein the first step portion and the second step portion arranged on opposite sides of the lamp base so as to define a central recess between the first step portion and the second step portion.

2. The lamp base of claim 1, further comprising a first key recess provided in the flat face of the first step portion.

3. The lamp base of claim 2, further comprising a second key recess provided in the flat face of the second step portion.

4. The lamp base of claim 1, wherein the first and second lower pin connectors are positioned symmetrically with respect to a center of the end surface.

5. The lamp base of claim 1, wherein the first and second lower pin connectors are positioned asymmetrically with respect to a center of the end surface.

6. The lamp base of claim 1, wherein the first step portion further comprises:
- a first truncated portion provided at a first end of the first step portion; and
- a second truncated portion provided at a second end of the first step portion.

7. The lamp base of claim 1, wherein the first step portion comprises a first truncated portion provided at a first end of the first step portion; and
- the second step portion comprises a first truncated portion provided at a first end of the first step portion.

8. A socket designed to couple with a lamp base comprising:
- a cylindrical body having an end surface;
- a central step portion extending perpendicular to the end surface, in a direction away from the cylindrical body, the central step portion comprising:
  - a first flat face extending perpendicular to the end surface; and
  - a second flat face extending perpendicular to the end surface;
- a first upper connector provided within a recess formed in the central step portion;
- a second upper connector provided within a recess formed in the central step portion;
- a first lower connector provided within a recess formed in the end surface; and
- a second lower connector provided within a recess formed in the end surface.

9. The socket of claim 8, further comprising a first key protrusion protruding from the first flat face.

10. The socket of claim 9, further comprising a second key protrusion protruding from the second flat face.

11. The socket of claim 8, wherein the first upper connector and second upper connector are positioned symmetrically with respect to a center of the end surface.

12. The socket of claim 9, wherein the first upper connector and the second upper connector are positioned asymmetrically with respect to a center of the end surface.

13. The socket of claim 8, further comprising:
- a first tapered portion extending outward from a first end of the first flat face; and
- a second tapered portion extending outward from a second end of the first flat face.

14. The socket of claim 8, further comprising:
- a first tapered portion extending outward from a first end of the first flat face; and
- a second tapered portion extending outward from a first end of the second flat face.

15. A lamp base and socket assembly for use with a lamp bulb, the assembly comprising:
- a lamp base structured to fit on an end of a lamp bulb, the lamp bulb comprising:
  - a cylindrical lamp base body having a base end surface;
  - a first step portion and a second step portion, each comprising a flat face extending perpendicular to the base end surface, and a raised face that is perpendicular to the flat face;
  - a first upper pin connector provided on the raised face of the first step portion and extending perpendicular to the first step portion;
  - a second upper pin connector provided on the raised face of the second step portion and extending perpendicular to the first step portion; and
  - a first and second lower pin connector provided on the base end surface and extending perpendicular to the end surface; and
- a socket structured to couple with the lamp base, the socket comprising
  - a cylindrical socket body having a socket end surface;

a central step portion extending perpendicular to the socket end surface, the central step portion comprising a first flat face extending perpendicular to the end surface; and a second flat face extending perpendicular to the end surface;

a first upper connector provided within a recess formed in the central step portion;

a second upper connector provided within a recess formed in the central step portion;

a first lower connector provided within a recess formed in the end surface; and a second lower connector provided within a recess formed in the end surface;

wherein the first lower connector and second lower connector are structured to couple with the first upper pin connector and the second upper pin connector, respectively;

the first upper connector and the second upper connector are structured to couple with the first lower pin connector and the second lower pin connector; and the central step portion is structured to fit between the first step portion and the second step portion when the socket and the lamp base are coupled.

16. The assembly of claim 15, further comprising:

a first key recess provided in the flat face of the first step portion;

a first key protrusion protruding from the first flat face;

wherein the first key protrusion is structured to align with the first key recess when the socket and lamp base are coupled together.

17. The assembly of claim 16, further comprising:

a second key recess provided in the flat surface of the second step portion;

a second key protrusion protruding from the second flat face;

wherein the second key protrusion is structured to align with the second key recess when the socket and lamp base are coupled together.

18. The assembly of claim 15, wherein the first step portion further comprises a first truncated portion provided at first end of the first step portion, and a second truncated portion provided at a second end of the first step portion;

a first tapered portion extends outward from a first end of the first flat face;

a second tapered portion extends outward from a second end of the first flat face; and the first tapered portion aligns with the first truncated portion and the second tapered portion aligns with the second truncated portion when the socket is coupled with the lamp base.

19. The assembly of claim 15, wherein the first step portion further comprises a first truncated portion provided at a first end of the first step portion;

the second step portion further comprises a second truncated portion provided at a first end of the first step portion;

a first tapered portion extends outward from a first end of the first flat face;

a second tapered portion extends outward from a first end of the second flat face; and the first tapered portion aligns with the first truncated portion and the second tapered portion aligns with the second truncated portion when the socket is coupled with the lamp base.

20. An adaptor structure for use with a lamp base comprising a first pin connector extending from an end of the lamp base and for coupling with a corresponding lamp socket, the adaptor comprising:

a flat face;

an end face formed perpendicular to the first flat face; and a key recess formed in the flat face;

wherein the adaptor is structured to attach to the end of the lamp base such that the flat face is perpendicular to the end of the lamp base and the first pin connector extends entirely through the adaptor whereby the pin connector is exposed to be mateable to the corresponding lamp socket.

* * * * *